United States Patent [19]

Nook et al.

[11] Patent Number: 4,800,821

[45] Date of Patent: Jan. 31, 1989

[54] DISPENSING RACK

[75] Inventors: Thomas J. Nook, Grand Haven; Henry G. Oltof, Spring Lake, both of Mich.

[73] Assignee: Harbor Industries, Grand Haven, Mich.

[21] Appl. No.: 18,032

[22] Filed: Feb. 24, 1987

[51] Int. Cl.[4] ..... A47B 3/00

[52] U.S. Cl. ..... 108/111; 108/106; 211/184; 211/190; 16/19; 16/26

[58] Field of Search ..... 248/354.4, 354.5; 41/184, 189, 190; 312/257 SK, 257 SM, 257 R, 111, 107; 108/96, 106, 110, 144, 111; 16/19, 21, 26, 32

[56] References Cited

U.S. PATENT DOCUMENTS

| | | | |
|---|---|---|---|
| 908,344 | 12/1908 | Simanek . | |
| 966,002 | 8/1910 | Fricke . | |
| 1,411,260 | 4/1922 | Baker et al. . | |
| 1,846,485 | 2/1932 | Hart . | |
| 2,176,913 | 10/1939 | Mandel | 312/141 |
| 2,342,452 | 2/1944 | Casteen | 312/42 |
| 3,202,298 | 8/1965 | Koreska | 211/184 |
| 3,297,374 | 1/1967 | Radek | 312/108 |
| 3,316,863 | 5/1967 | Zock | 108/108 |
| 3,368,856 | 2/1968 | Tisdall et al. | 312/111 |
| 3,494,686 | 2/1970 | Diack | 312/140 |
| 3,501,019 | 3/1970 | Armstrong et al. | 211/184 |
| 3,544,181 | 12/1970 | Schottland | 312/114 |
| 3,557,401 | 1/1971 | Jenkins | 16/26 |
| 3,606,506 | 9/1971 | Ungaro | 312/111 |
| 3,608,989 | 9/1971 | Wurster et al. | 312/257 |
| 3,876,270 | 4/1975 | White | 312/257 |
| 3,973,371 | 8/1976 | Heller | 52/758 |
| 4,007,853 | 2/1977 | Bahneman | 221/3 |
| 4,055,253 | 10/1977 | Oztekin | 211/189 |
| 4,067,161 | 1/1978 | Rensch | 52/285 |
| 4,128,284 | 12/1978 | King | 312/330 |
| 4,130,326 | 12/1978 | Harnblad | 312/292 |
| 4,148,263 | 4/1979 | Suttles | 108/111 X |
| 4,156,391 | 5/1979 | Ubezio | 108/144 X |
| 4,166,516 | 9/1979 | Thurmond | 16/19 X |
| 4,226,488 | 10/1980 | Vincent | 312/257 |
| 4,235,493 | 11/1980 | Bridges et al. | 312/257 |
| 4,305,628 | 12/1981 | Glasener | 312/42 |
| 4,395,080 | 7/1983 | Winn et al. | 312/257 |
| 4,396,237 | 8/1983 | Henry | 312/42 |
| 4,433,880 | 2/1984 | Maravelas, Jr. et al. | 312/3 |
| 4,468,067 | 8/1984 | Jenkins | 312/140 |
| 4,541,675 | 9/1985 | Everett | 312/257 |
| 4,556,148 | 12/1985 | Koller | 211/189 |
| 4,558,647 | 12/1985 | Peterson | 108/107 |
| 4,566,596 | 1/1986 | Hennig | 211/59.2 |
| 4,566,742 | 1/1986 | Schmied | 312/257 |

FOREIGN PATENT DOCUMENTS

| | | | |
|---|---|---|---|
| 506299 | 10/1951 | Belgium | 248/354.4 |
| 817753 | 2/1967 | Canada | 108/109 |
| 2140229 | 2/1973 | Fed. Rep. of Germany | 108/109 |
| 83126 | 10/1956 | Netherlands | 108/109 |

OTHER PUBLICATIONS

R. J. Reynolds Display Rack, no date.

*Primary Examiner*—Joseph Falk

*Attorney, Agent, or Firm*—Price, Heneveld, Cooper, DeWitt & Litton

[57] ABSTRACT

A dispensing rack has a knockdown construction that permits quick and easy assembly and disassembly without any tools. The rack construction is also modular to facilitate varying the size and shape of the rack, and to greatly reduce manufacturing and transportation costs. Hanging row dividers stabilize and separate adjacent stacks of articles. Adjustable shelf jacks and casters provide additional rigidity for the shelves, and facilitate moving the rack from one location to another. A header assembly permits use of common parts to construct a low profile version of the rack.

41 Claims, 21 Drawing Sheets

FIG. 44
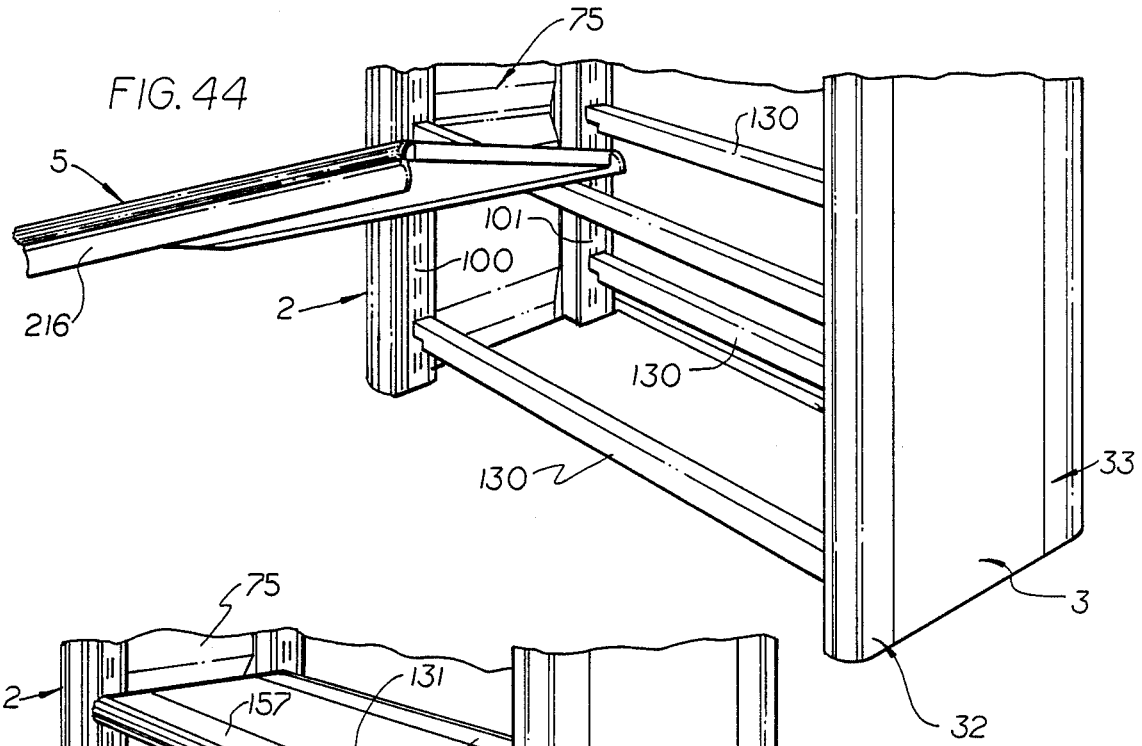
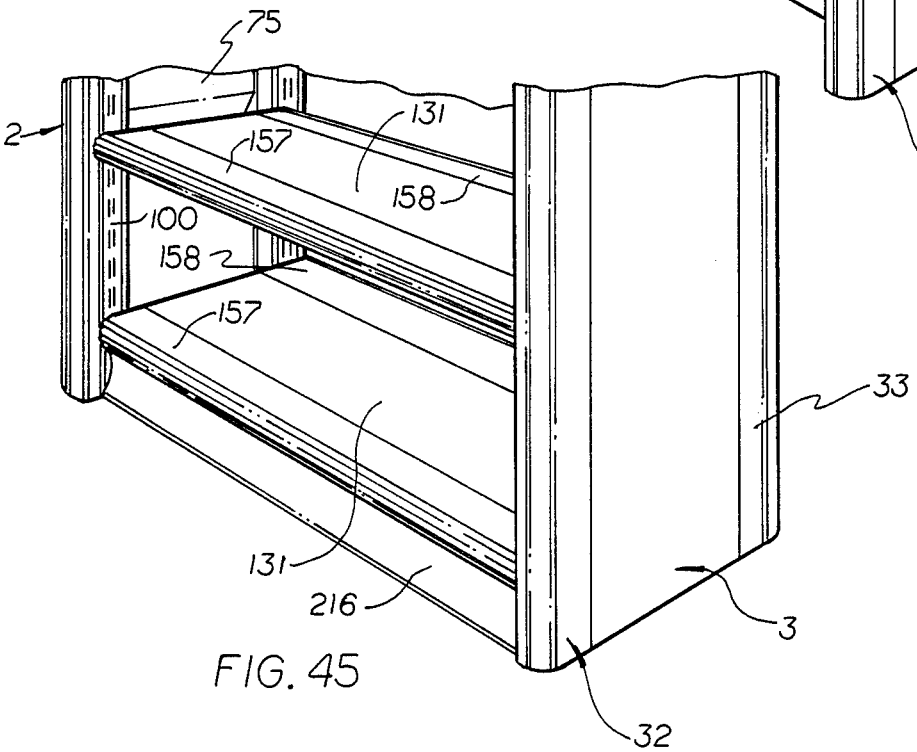
FIG. 45

76
85
75
87
78
86
89
80
77

76
85
75
~81~
27
92
87
88
~93~
80
78
79
86
85
89
87
~82~
80
88
90
~83~
88
91
~84~
87
88
77

2
16
75
27
5
131
5
5
89
82
5
131
89
83
5
89
84
5
77

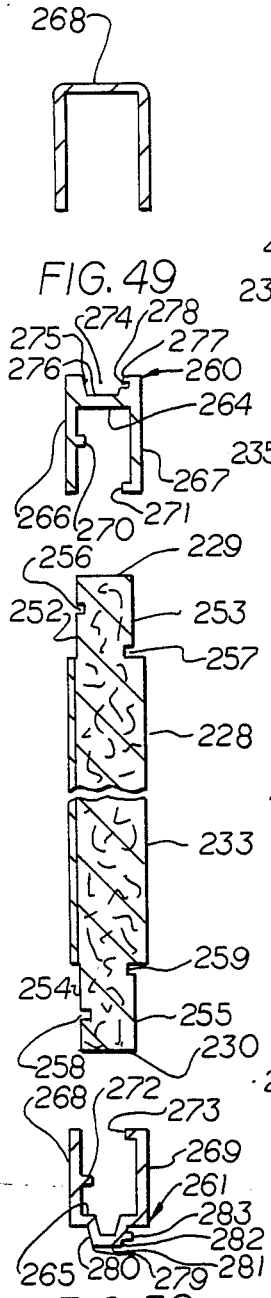
FIG. 49
FIG. 50
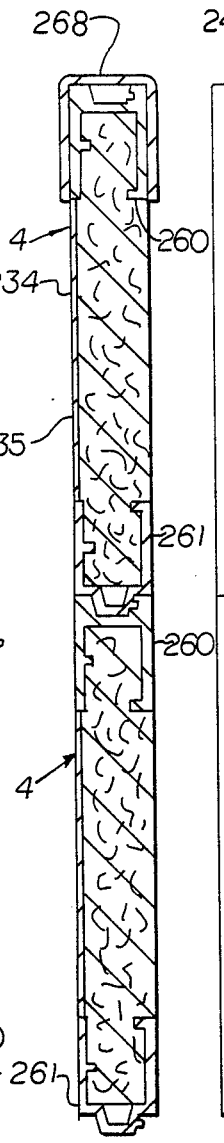
FIG. 51
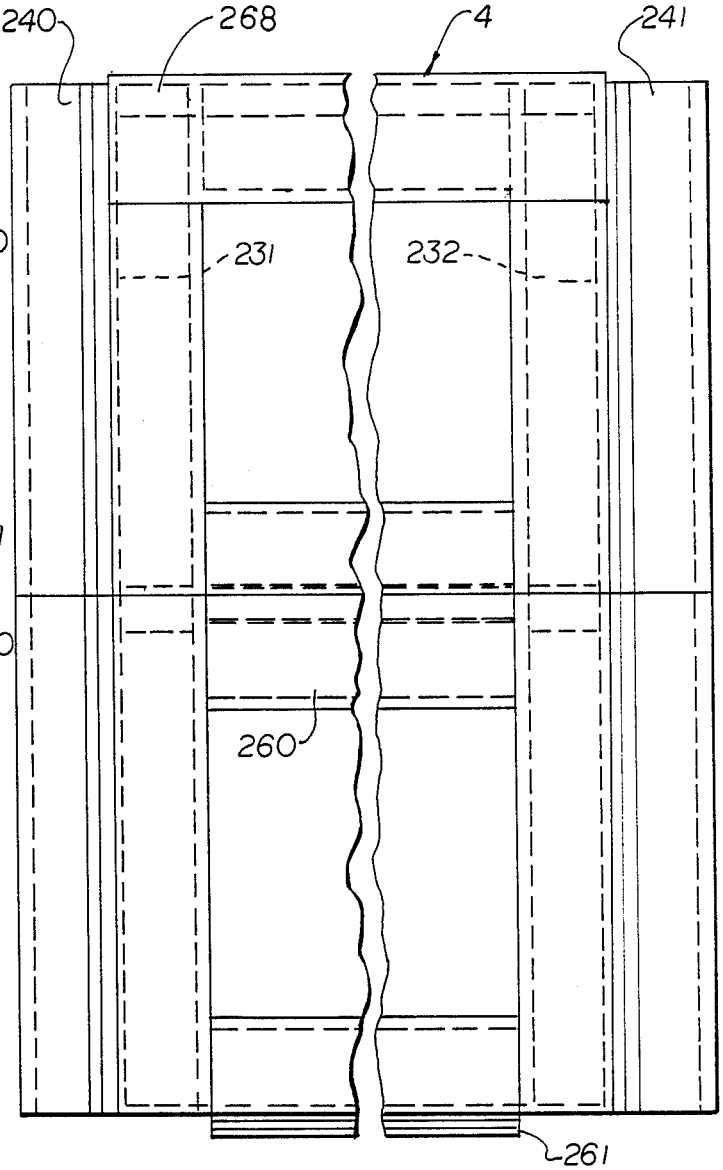
FIG. 52
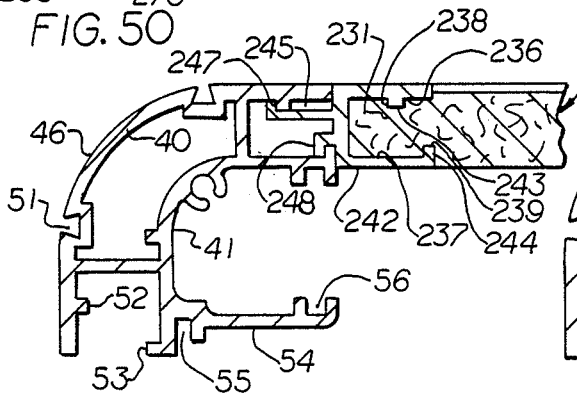
FIG. 53
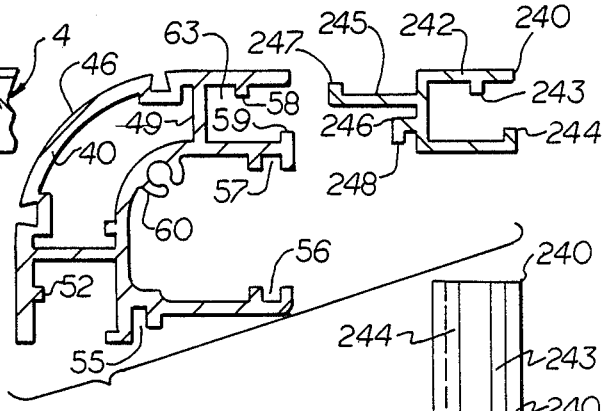
FIG. 54
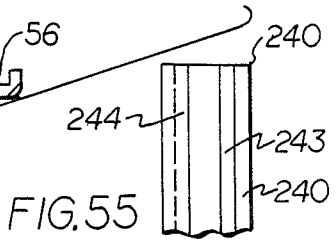
FIG. 55

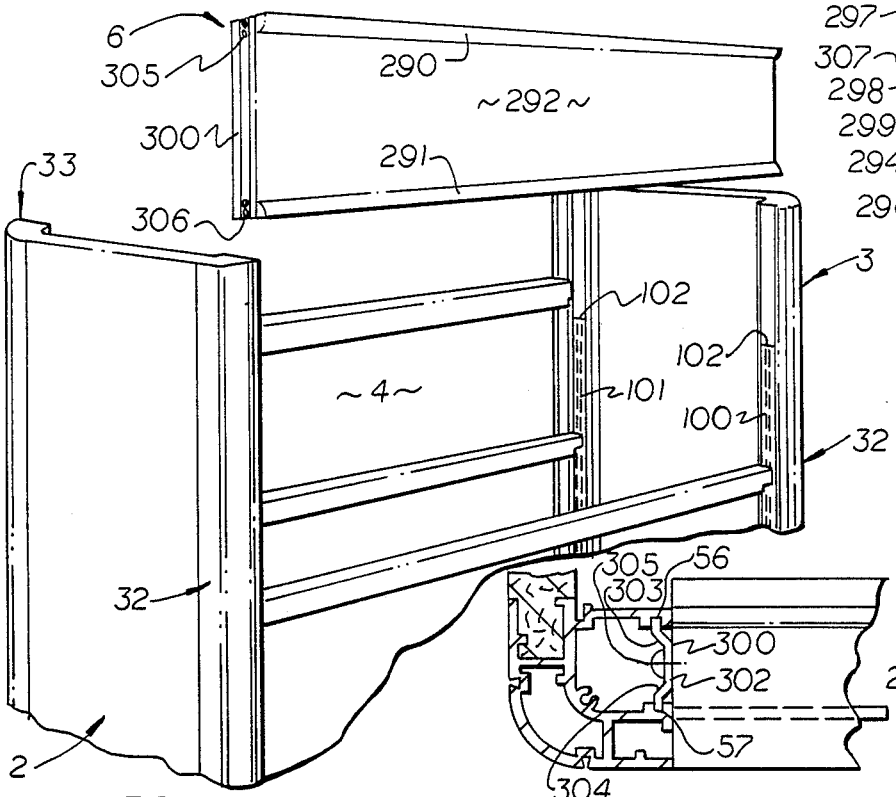
FIG.56
FIG. 57
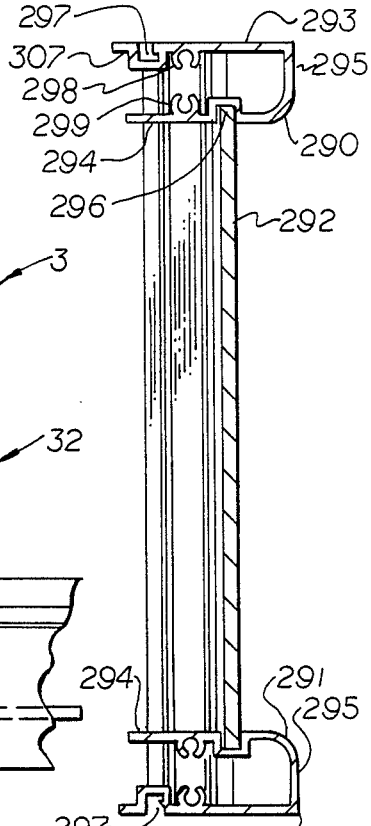
FIG.58
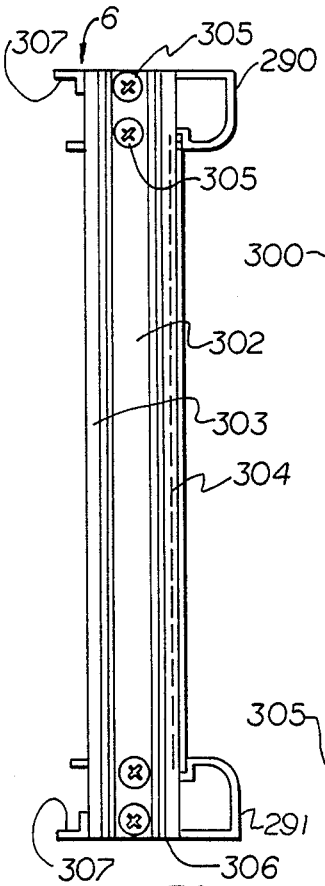
FIG.59
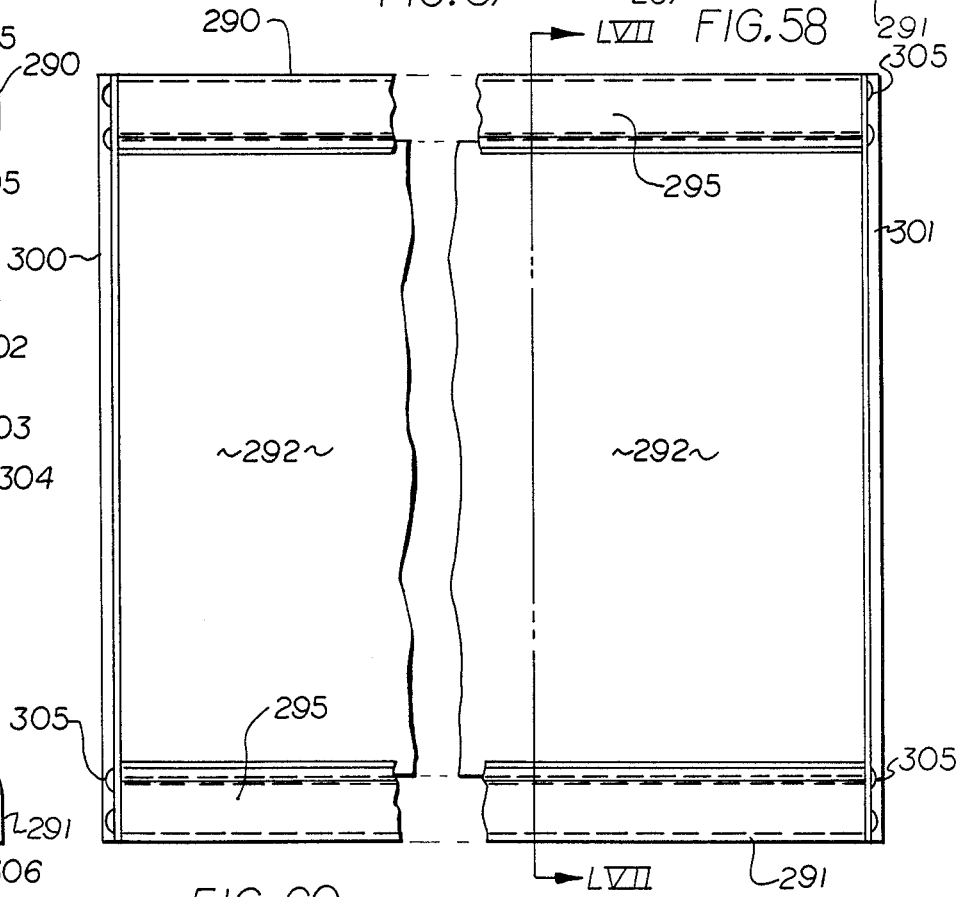
FIG. 60

330
335
332
329
8
324
331
335
332
329

327
326

333
328
334
335
329
332
323
292
325
9
344
346
345
331
339
336
296
297
330
338
292
332
335
307
340
337

8
260
4

2
157
131
158
160
160
4
8
101
100
32
33

359
360
355
356
357
358
365
366
367
368
369
370
371
372
373
374
375
376
377
378
4
5
10
131
157
160

FIG. 78
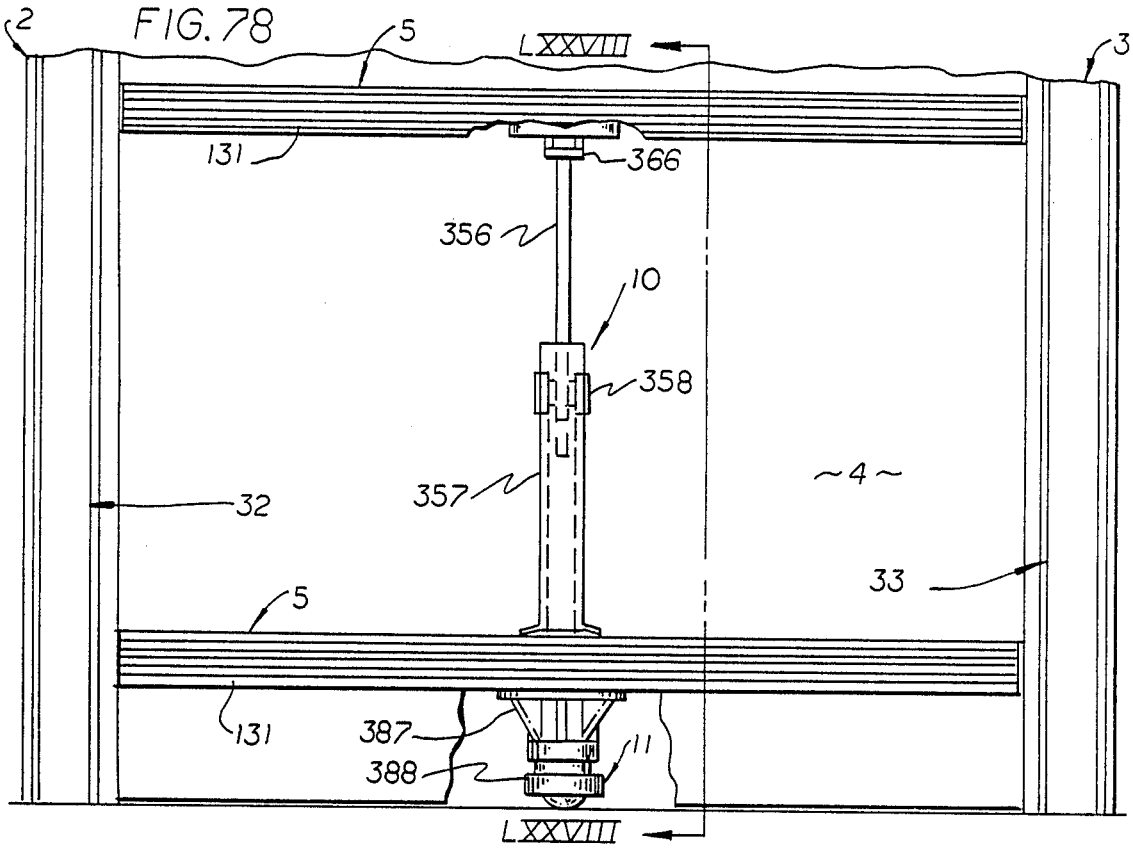
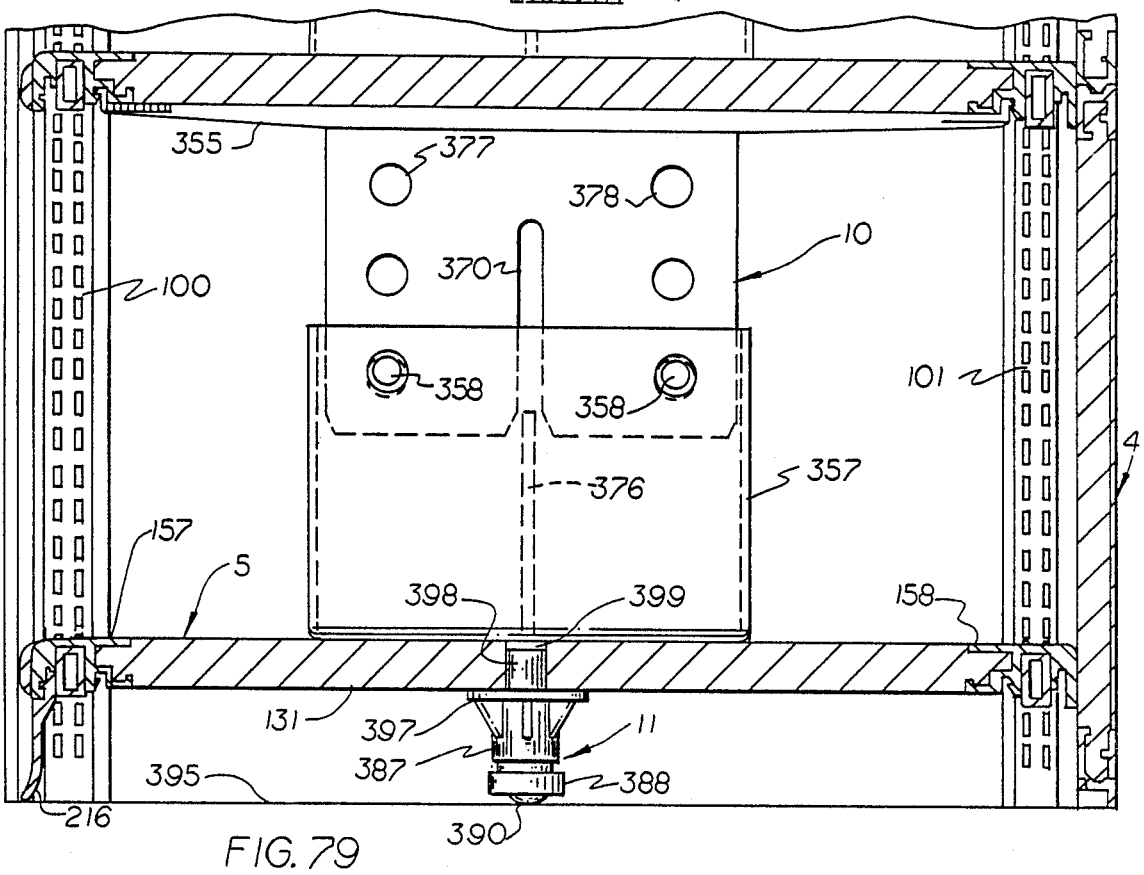
FIG. 79

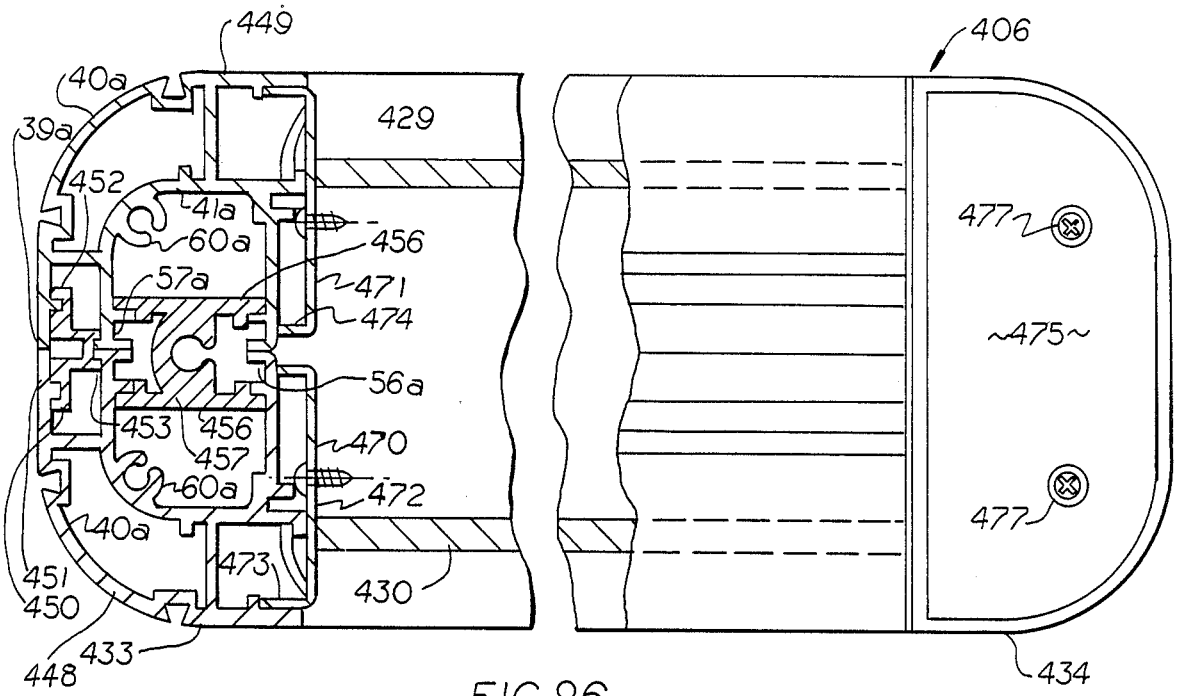
FIG. 86
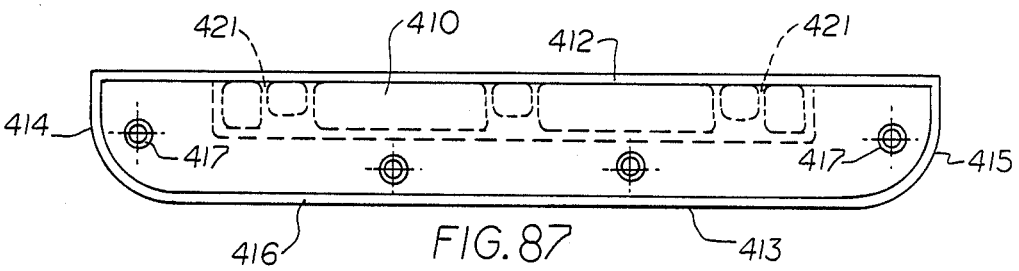
FIG. 87
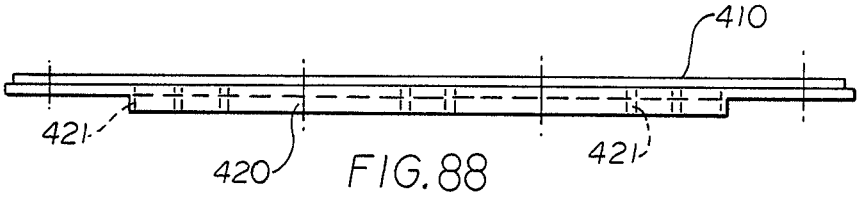
FIG. 88
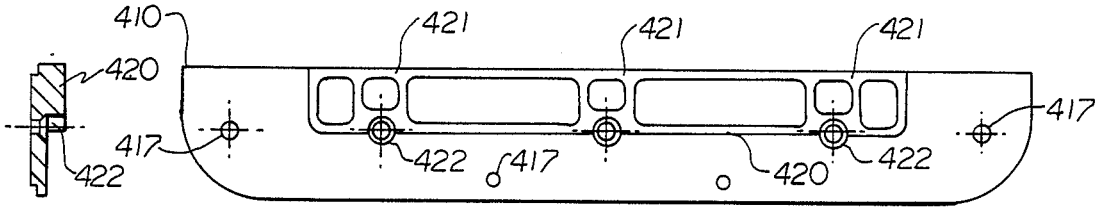
FIG. 90
FIG. 89

DISPENSING RACK

BACKGROUND OF THE INVENTION

The present invention relates to racks, and in particular to a rack for dispensing vertically stacked articles, such as cigarette cartons, photographic film, cassette tapes, and the like.

Dispensing racks for stacked articles, such as the devices disclosed in U.S. Pat. No. 4,007,853 to Bahneman, and U.S. Pat. No. 4,566,596 to Henning, are well known in the art. Such racks are typically used in grocery stores, drug stores, supermarkets, and other similar establishments to both display and dispense regularly shaped articles therefrom, such as cartons of cigarettes, boxes of photographic film, audio and video cassettes, and other similar prepackaged products, such as electronic components, and the like.

Most prior dispensing racks have a multi-piece construction, and are assembled with threaded fasteners, therefore requiring substantial time and effort to assemble and disassemble. Since the space in many dispensing racks is leased by the manufacturer or merchandiser of the articles dispensed therefrom, the racks tend to be moved from one store location to another, as well as between various locations within a given store, on a rather frequent basis During the time that the rack is being assembled and disassembled, it is not available for merchandising use, and furthermore the assembly and disassembly process tends to disrupt other store activities. Hence, the ability to easily and quickly assemble and disassemble such racks is quite important.

Another desirable feature for dispensing racks is the ability to economically change its configuration to accommodate new settings and different products. Furthermore, dispensing racks are preferably arranged to efficiently store a large number of stacked articles with minimum floor space requirements, yet permit easy insertion and removal of the articles from the shelves without jamming.

SUMMARY OF THE INVENTION

One aspect of the present invention is to provide a unique shelf support bar for dispensing racks. First and second end panels are provided with slotted portions extending longitudinally therealong in a mutually spaced apart relationship. The shelf support bar is shaped to extend between the end panels, and supports at least a portion of an associated shelf thereon. The support bar has opposite ends shaped for close reception in mating slots in the end panels, and includes downwardly opening notches that are shaped to closely receive therein the lowers edge of the slots. The support bar notches are spaced apart a distance substantially equal to the lateral distance between the end panels, whereby to releasably interconnect the end panel in an upright, freestanding condition, the first end of the shelf support bar is inserted into the first slot past the first notch, and the shelf support bar is then bodily translated longitudinally in the opposite direction to insert the second end of the shelf bar into the second slot, until the first and second notches contemporaneously engage the lower edges of the slots, thereby permitting quick and easy assembly and disassembly of the dispensing rack without any tools.

Yet another aspect of the present invention is a modular rack construction, comprising a pair of end panels, each having a rigid, flat panel, with a pair of elongate corner brackets rigidly connected to and extending along the opposite side edges of the rigid panel. The corner brackets have a generally L-shaped lateral cross-sectional configuration, with opposing first and second faces. A pair of slotted uprights are operably connected with the first face of each corner bracket, and includes a plurality of slots extending therethrough. At least one shelf, and an associated shelf support bar extend between the end panels. The shelf support bar has opposite end shaped for insertion into selected slots in the upright, and releasably engages the same to support the shelf thereon.

Yet another aspect of the present invention is a modular back construction for dispensing racks of the type having end panels with shelves extending therebetween. The modular back construction comprises at least two rigid back panels shaped to extend between the end panels along rearward side edges thereof. A pair of slots are disposed in the end panels along the rearward side thereof, and are shaped to slidingly receive the side edges of the back panel, and retain the back panel therein in a vertically stacked relationship. Male channels are positioned along the lower edge of the back panels, and include downwardly protruding, wedge-shaped ribs with inclined sides that converge in a downwardly direction. Female channels are positioned along the upper edges of the back panels, and include generally upwardly protruding, wedge-shaped grooves with inclined sides which converge in a downwardly direction. The grooves are shaped to closely receive the ribs therein, whereby the male and female channels on adjacent back panels mate when assembled in the vertically stacked relationship to structurally interconnect the back panels, and form a seal therebetween.

Yet another aspect of the present invention is a row divider for dispensing racks. The row divider comprises a divider panel having a height substantially commensurate with the vertical distance between adjacent upper and lower shelves, and a depth which is less than the depth of the lower shelf. The divider panel is supported from the upper shelf, such that the divider panel extends downwardly from the upper shelf in a substantially vertical orientation to a point near and/or adjacent to the lower shelf, whereby the divider separates laterally adjacent rows of vertically stacked articles, and prevents the same from toppling sideways.

Yet another aspect of the present invention is an adjustable shelf jack for dispensing racks, having a sleeve-shaped housing with a central aperture in which a jack plate is telescopingly received. The jack housing and jack plate each contain at least one pair of laterally aligned apertures in which a jack pin is received, such that the jack can be easily adjusted to fit snugly between adjacent shelves to provide vertical rigidity therebetween.

Yet another aspect of the present invention is an adjustable caster for dispensing racks, comprising a housing operably connected with the central portion of a shelf. A caster wheel is rotatably mounted in the caster housing, and is adapted for ground engaging contact with a support surface. A mechanism is provided for raising and lowering the caster wheel with respect to the shelf, whereby the caster wheel can be lowered into abutting contact with the support surface to facilitate moving the rack over the support surface, and to provide vertical rigidity to the shelf.

Yet another aspect of the present invention is a header assembly for dispensing racks. The rack comprises a pair of end panels, each having a rigid flat panel, with a pair of elongate corner brackets rigidly attached to the opposite side edges of the panel. The corner brackets have a generally L-shaped lateral cross-sectional configuration, with opposite, first and second faces. A pair of inwardly facing grooves extend along the first face of each of the corner brackets. At least one shelf is supported between the end panels, and the header assembly extends between the end panels at the upper ends thereof. The header includes first and second slides operably connected with the opposite sides of the header, and includes outwardly protruding flanges closely and slidingly received in the inwardly facing grooves of the corner brackets to quickly and securely mount the header in the dispensing rack.

Yet another aspect of the present invention is an adjustable header assembly for low profile dispenser racks. The header assembly includes a pair of top caps connected with the upper ends of the end panels, which include at least one pair of vertically oriented, laterally aligned sockets. A pair of support columns have their lower ends received in the sockets of the top caps, and are operably connected therewith to rigidly mount the support columns on the end panels in an upright orientation. A header panel extends between the end panels, and has at least one face adapted to display indicia thereon. The header panel includes a pair of vertically oriented sockets disposed adjacent the opposite ends thereof in which the upper ends of the support columns are closely received to slidingly mount the header panel on the support columns above the end panel. A stop is detachably connected with at least one of the support columns, and is shaped to selectively engage the header panel to adjustably retain the same at a selected height above the end panels.

The principal objects of the present invention are to provide a dispensing rack with a knockdown construction that permits even relatively unskilled personnel to quickly and easily assemble and disassemble the rack without any tools whatsoever. The rack requires reduced floor space, yet stores more product with increased exposure for better display and merchandising. The rack has a modular construction that renders it versatile enough to be attractive to a wide range of merchandisers with varying space requirements. The rack construction uses many common parts that are interconnected in different ways to make a wide variety of differently shaped racks, each having an attractive appearance with a common visual theme, to provide a neat, consistent appearance throughout the store. The rack is quite flexible to accommodate changing merchandising techniques, and can be quickly and easily disassembled to alleviate the disruption of store business, and minimize labor expenses. The rack is extremely strong with a durable construction that provides an extended operating life. The modular construction permits disassembly into a very compact state for ease of shipment, and has many times fewer parts than standard dispensing racks to reduce manufacturing costs and assembly effort. The rack can be easily customized to permit units to be placed in spaces previously unavailable due to size and space constraints.

These and other features, advantages and objects of the present invention will be further understood and appreciated by those skilled in the art by reference to the following written specification, claims and appended drawings.

BRIEF DESCRIPTION OF THE DRAWINGS

FIG. 44 is a fragmentary, perspective view of the dispensing rack, with the shelf shown in an angled orientation ready for insertion on a mating pair of shelf support bars.

FIG. 45 is a fragmentary, perspective view of the dispensing rack, wherein two shelves have been installed in the two, lowermost positions.

FIG. 49 is a vertical cross-sectional view of a back panel cover strip portion of the present invention.

FIG. 50 is a fragmentary, exploded, vertical cross-sectional view of a back panel portion of the present invention.

FIG. 51 is a vertical cross-sectional view of a pair of back panels shown in a vertically stacked and interlocked condition.

FIG. 52 is a fragmentary, rear elevational view of the back panels illustrated in FIG. 51.

FIG. 53 is a fragmentary, horizontal cross-sectional view of a back panel, shown assembled into a mating corner bracket.

FIG. 54 is a vertical cross-sectional view of a side channel portion of the back panel, shown exploded away from a mating corner bracket.

FIG. 55 is a fragmentary, end elevational view of the back panel channel.

FIG. 56 is a perspective view of a header assembly portion of the present invention, shown exploded away from the upper portion of the dispensing rack.

FIG. 57 is a fragmentary, top plan view of the header assembly, shown installed in a mating corner bracket.

FIG. 58 is a vertical cross-sectional view of the header assembly, taken along the line LVII—LVII of FIG. 60.

FIG. 59 is an end elevational view of the header assembly.

FIG. 60 is a fragmentary, front plan view of the header assembly.

FIG. 78 is a fragmentary, front elevational view of the dispensing rack, with portions thereof broken away to reveal the shelf jack and a caster anchor installed therein.

FIG. 79 is a fragmentary, vertical cross-sectional view of a lower portion of the dispensing rack, showing the shelf jack and anchor caster installed therein.

FIG. 86 is a fragmentary, top plan view of the low profile header, wherein portions thereof have been broken away to reveal internal construction.

FIG. 87 is a top plan view of a top cap portion of the low profile header.

FIG. 88 is a side elevational view of the top cap.

FIG. 89 is a bottom plan view of the top cap.

FIG. 90 is a vertical cross-sectional view of the top cap.

DETAILED DESCRIPTION OF THE PREFERRED EMBODIMENTS

Figure 1:
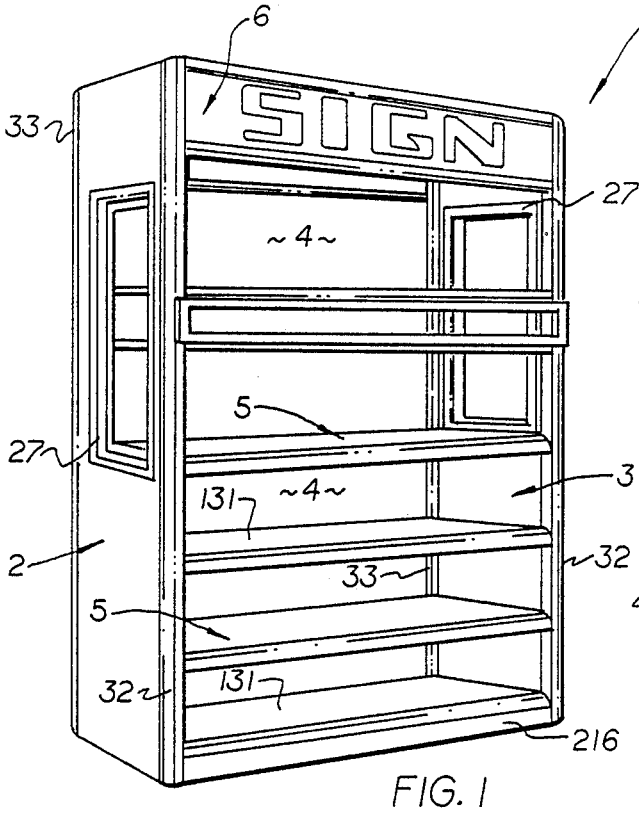
FIG. 1 is a perspective view of a dispensing rack embodying the present invention, taken generally from the front thereof.
Figure 2:
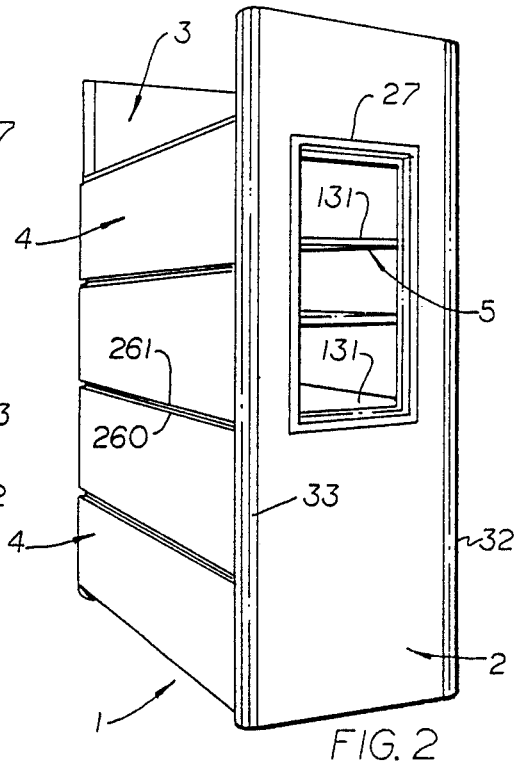
FIG. 2 is a perspective view of the dispensing rack, taken generally from the rear thereof.
Figure 3:
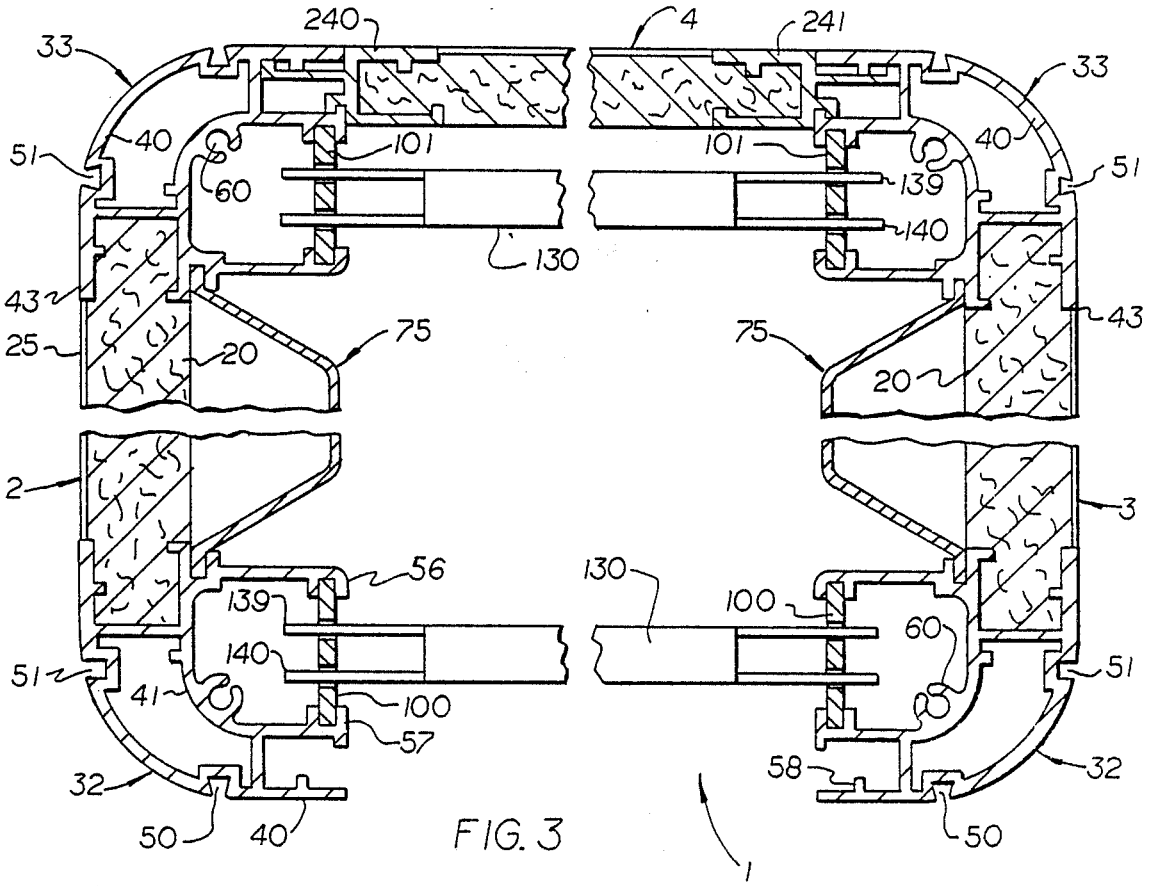
FIG. 3 is a fragmentary, horizontal, cross-sectional view of the dispensing rack.

For purposes of description herein, the terms "upper," "lower," "right," "left," "rear," "front," "vertical," "horizontal," and derivatives thereof shall relate to the invention as oriented in FIGS. 1 and 3. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 80:
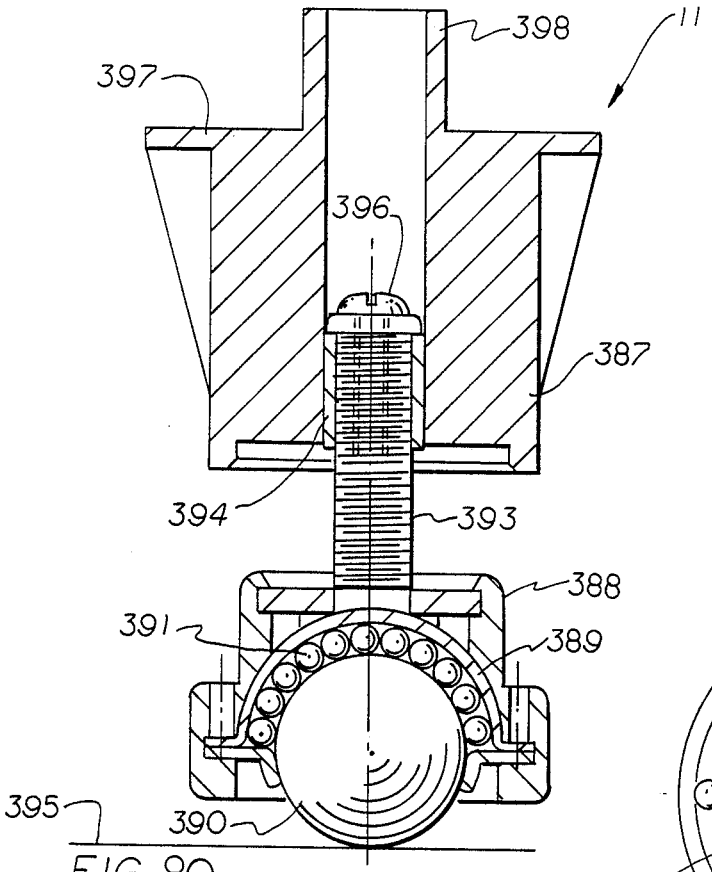
FIG. 80 is a vertical cross-sectional view of the anchor caster.
Figure 81:
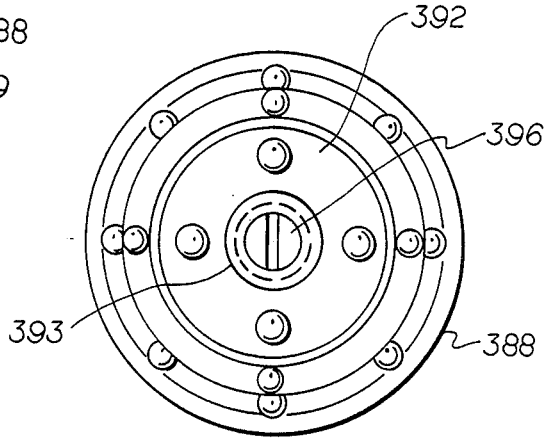
FIG. 81 is a top plan view of a lower half of the anchor caster.
Figure 82:
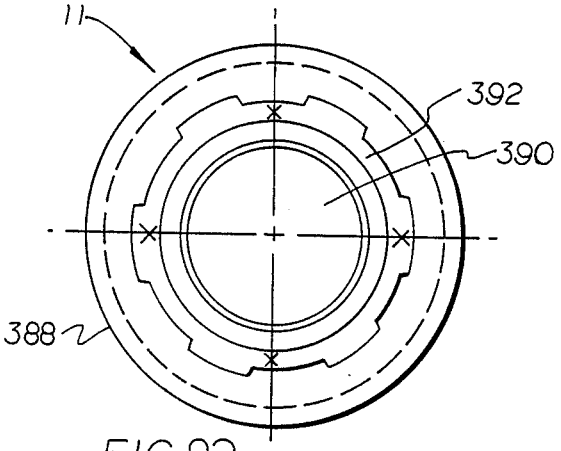
FIG. 82 is a bottom plan view of the anchor caster.

The reference numeral 1 (FIG. 1) generally designates a dispensing rack embodying the present invention. Rack 1 comprises a pair of end panels 2 and 3, a plurality of back panels 4, a plurality of shelf assemblies 5, and a header assembly 6. An add-on shelf kit 7 (FIG. 61) may be assembled on rack 1 to provide additional storage. Row dividers 8 (FIGS. 62–65) are provided to separate and stabilize adjacent vertical stacks of articles supported on shelf assemblies 5. A light diffuser panel 9 (FIG. 67) may be provided at the upper end of rack 1 to impart a neat, finished appearance to the rack. A shelf jack 10 (FIGS. 78–79) may be provided between shelf assemblies 5 to vertically stabilize and support the same. An anchor caster 11 (FIGS. 80–82) may be mounted in the lowermost shelf assembly 5 to provide vertical stability for shelf assemblies 5, and facilitate transport.

Figure 4:
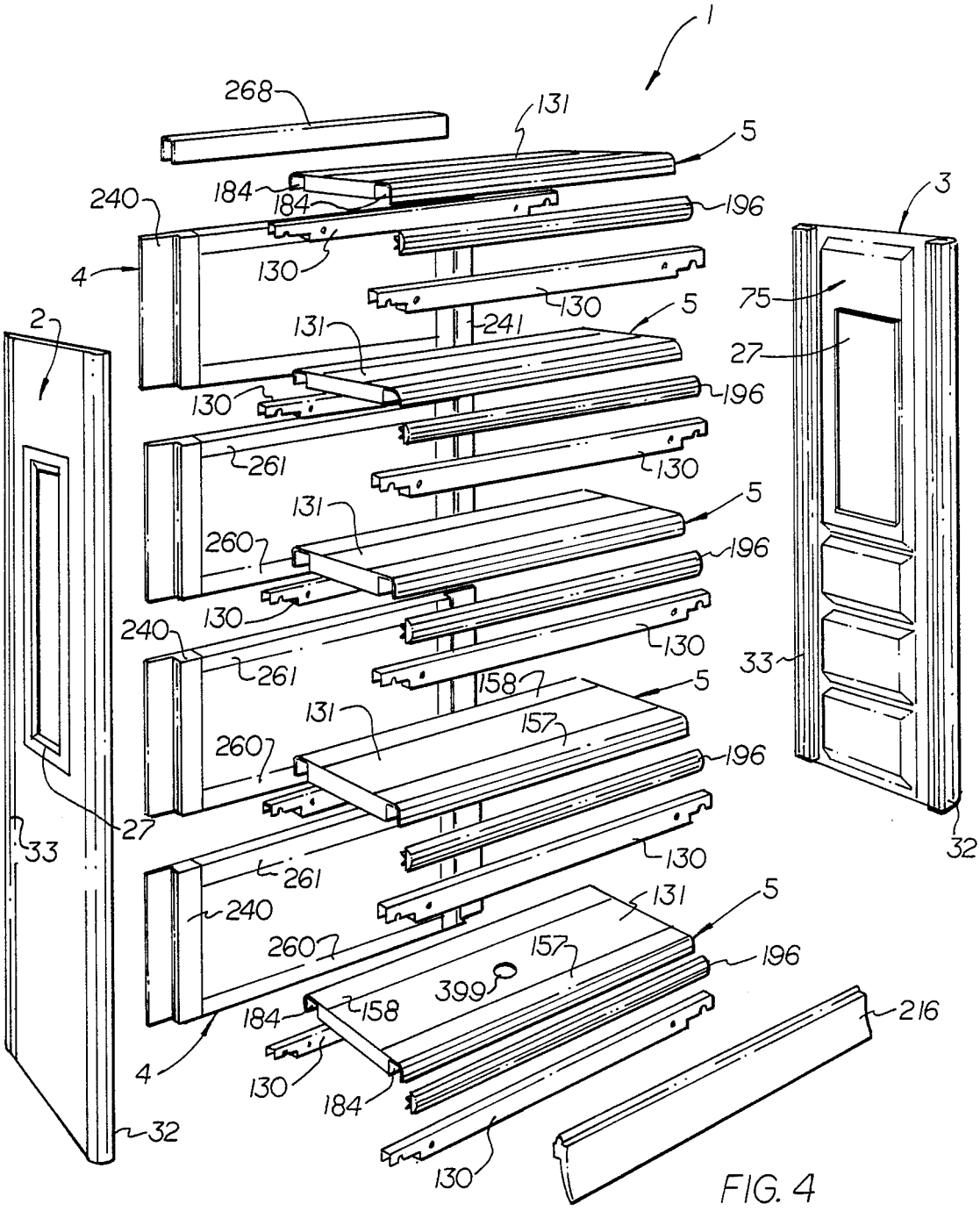
FIG. 4 is an exploded, perspective view of the dispensing rack.

In the illustrated example, end panels 2 and 3 (FIG. 4) are substantially identical, and are disposed at opposite sides of dispensing rack 1. Since the illustrated end panels 2 and 3 are substantially identical, the detailed description provided herein shall relate only to the left-hand end panel 2, with similar parts on right-hand end panel 3 bearing similar reference numerals.

End panel 2 (FIGS. 5–8) includes a rigid, flat panel 20, which in the present example, has a rectangular elevational shape, with an upper edge 21, a lower edge 22, and opposite side edges 23 and 24. Panel 20 is preferably constructed from a strong durable material, such as a dense particle board, or the like. The exterior face of panel 20 is preferably covered by a layer or sheet 25 of an imperforate, maintenance free material, such as vinyl, or the like, and may include a decorative, wood grain appearance. The illustrated panel 20 includes a rectangular aperture 26 in which a window assembly 27 is mounted to improve product exposure. The opposite side edges 23 and 24 of panel 20 both include recessed surfaces 34–37 with associated end shoulders and a pair of inwardly extending grooves 28–29 and 30–31 for mounting a pair of corner brackets 32 and 33 to panel 2, in the manner described in greater detail below.

In the illustrated example, corner brackets 32 and 33 are substantially identical, and are preferably constructed from a length of elongate, rigid stock having a lateral cross-sectional shape that is substantially uniform along its entire length. Since corner brackets 32 and 33 are substantially identical, for ease in description, reference herein shall be had only to corner bracket 32, with similar parts on corner bracket 33 bearing the same reference numerals.

With reference to FIGS. 5–8, corner bracket 32 has a generally L-shaped lateral cross-sectional configuration, with first and second faces 38 and 39 respectively. Corner bracket 32 comprises two, generally arcuately shaped walls 40 and 41 disposed in a mutually parallel relationship. Corner bracket walls 40 and 41 include outer ends 42–44, and curved or rounded medial sections 46 and 47. Two continuously extending, integrally formed webs 48 and 49 rigidly interconnect corner bracket walls 40 and 41, and retain the same in a selected, spaced apart relationship. Two dovetail-shaped grooves 50 and 51 extend along the exterior surfaces of outer wall 40 on opposite sides of medial section 46, and provide a connector for purposes to be described in greater detail hereinafter.

The second face 39 of corner bracket 32 defines a flange between walls 40 and 41, and includes two ribs 52 and 53, which extend inwardly from the interior surfaces of walls 40 and 41. Rib 53 is disposed along the terminal edge of bracket end 45, and rib 52 is positioned between the bracket end 43 and web 48. Hence, ribs 52 and 53 are staggered in a fore-to-aft relationship, but are oriented generally parallel. A flange 54 extends laterally inwardly from bracket wall 41, adjacent outer end 45. Flange 54 includes a first, U-shaped groove 55 at its inward end, which faces toward corner bracket 33, and a second, U-shaped groove 56 at the free end thereof, which faces forwardly toward wall end 44. A mating U-shaped groove 57 is positioned on inner bracket wall 41, adjacent end 44, which faces inwardly, and is laterally aligned with groove 56.

The first face 38 (FIGS. 5–8) of corner bracket 32 also defines a flange between walls 40 and 41, and includes two ribs 58 and 59 which extend toward each other from the inner surfaces of bracket walls 40 and 41. Rib 59 is disposed along the terminal edge of end 44 of inner bracket wall 42, and rib 58 is disposed between bracket end 42 and web 49. Hence, ribs 58 and 59 are arranged in a laterally staggered fashion, and extend in a generally parallel relationship. A boss 60 extends along the arcuate portion 47 of inner bracket wall 41, and has a split, cylindrically-shaped construction for purposes to be described in greater detail hereinafter. In one embodiment of the present invention, corner brackets 32 and 33 are constructed from sections of extruded aluminum channel.

The laterally opening space disposed between inner and outer walls 40 and 41 at bracket ends 42 and 44 defines a groove 63. The fore-to-aft opening space disposed between inner and outer walls 40 and 41 at bracket ends 43 and 45 defines a groove 64.

Figure 5:
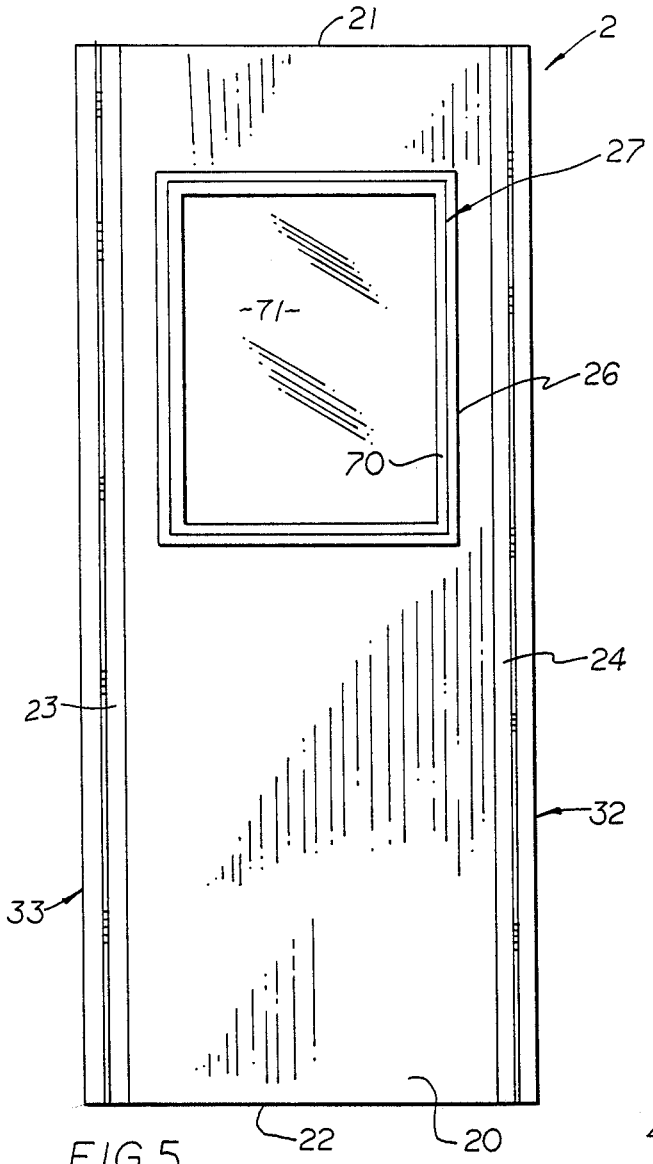
FIG. 5 is a front elevational view of an end panel portion of the dispensing rack.
Figure 6:
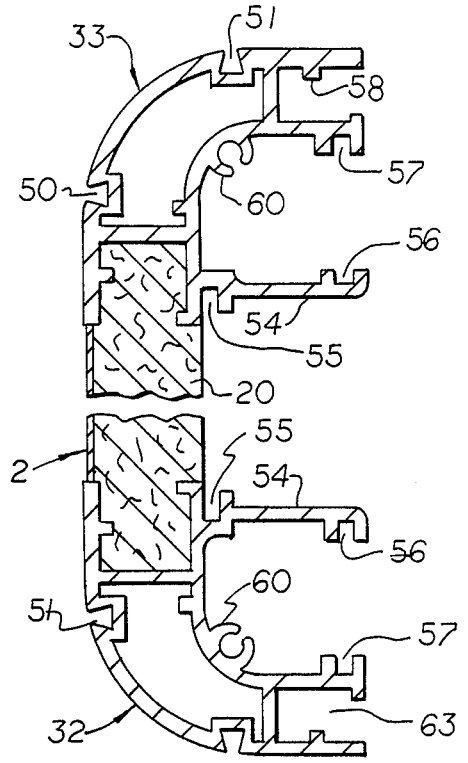
FIG. 6 is a fragmentary, horizontal cross-sectional view of the end panel.
Figure 7:
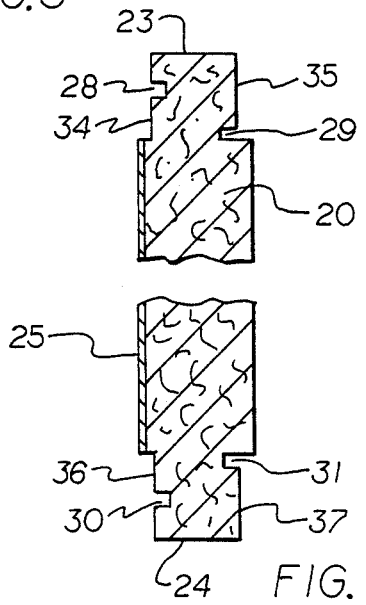
FIG. 7 is a fragmentary, horizontal cross-sectional view of a panel portion of the end panel.
Figure 8:
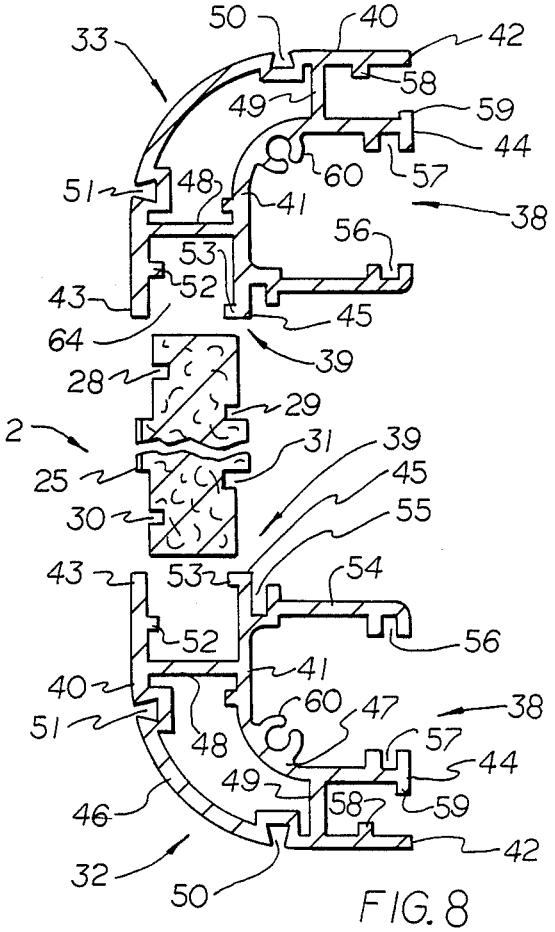
FIG. 8 is an exploded, fragmentary, horizontal cross-sectional view of the end panel.
Figure 9:
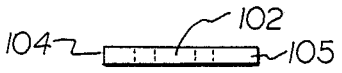
FIG. 9 is a top plan view of an upright portion of the dispensing rack.
Figure 11:
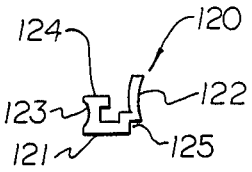
FIG. 11 is a top plan view of a cover strip portion of the dispensing rack.

When assembled into the configuration illustrated in FIGS. 5 and 6, end panel 2 has corner brackets 32 and 33 mounted along the side edges 23 and 24 of panel 20. The recessed surfaces 34–37 of panel 20 are closely received within the flanges formed between bracket walls 40 and 41 at the second faces 39 of corner brackets 32 and 33. The ribs 52 and 53 on corner bracket 32 are received in mating grooves 30 and 31 respectively of panel 20. The terminal edges of bracket ends 43 and 45 abut the mating end shoulders on the recessed surfaces 36 and 37 of panel 20. In like manner, ribs 52 and 53 of corner bracket 33 are closely received in mating grooves 30 and 31 respectively of panel 20, with the terminal edges of bracket ends 43 and 45 abutting the opposite end shoulders on the recessed surfaces 34 and 35 of panel 20. Corner brackets 32 and 33 are fixedly attached to panel 20 to prevent longitudinal movement therebetween by suitable means, such as staking, or simply frictional contact between corner brackets 32 and 33 and the associated side edges 23 and 24 of panel 20.

As best illustrated in FIG. 5, the window assembly 27 of end panel 2 comprises a rectangular marginal frame 70, having a rigid, transparent panel 71 mounted therein. Window assembly 27 is mounted in opening 26 of panel 20 in a conventional fashion, and provides additional visual exposure of product contained in rack 1 for improved display.

Figures 46, 47, 48:
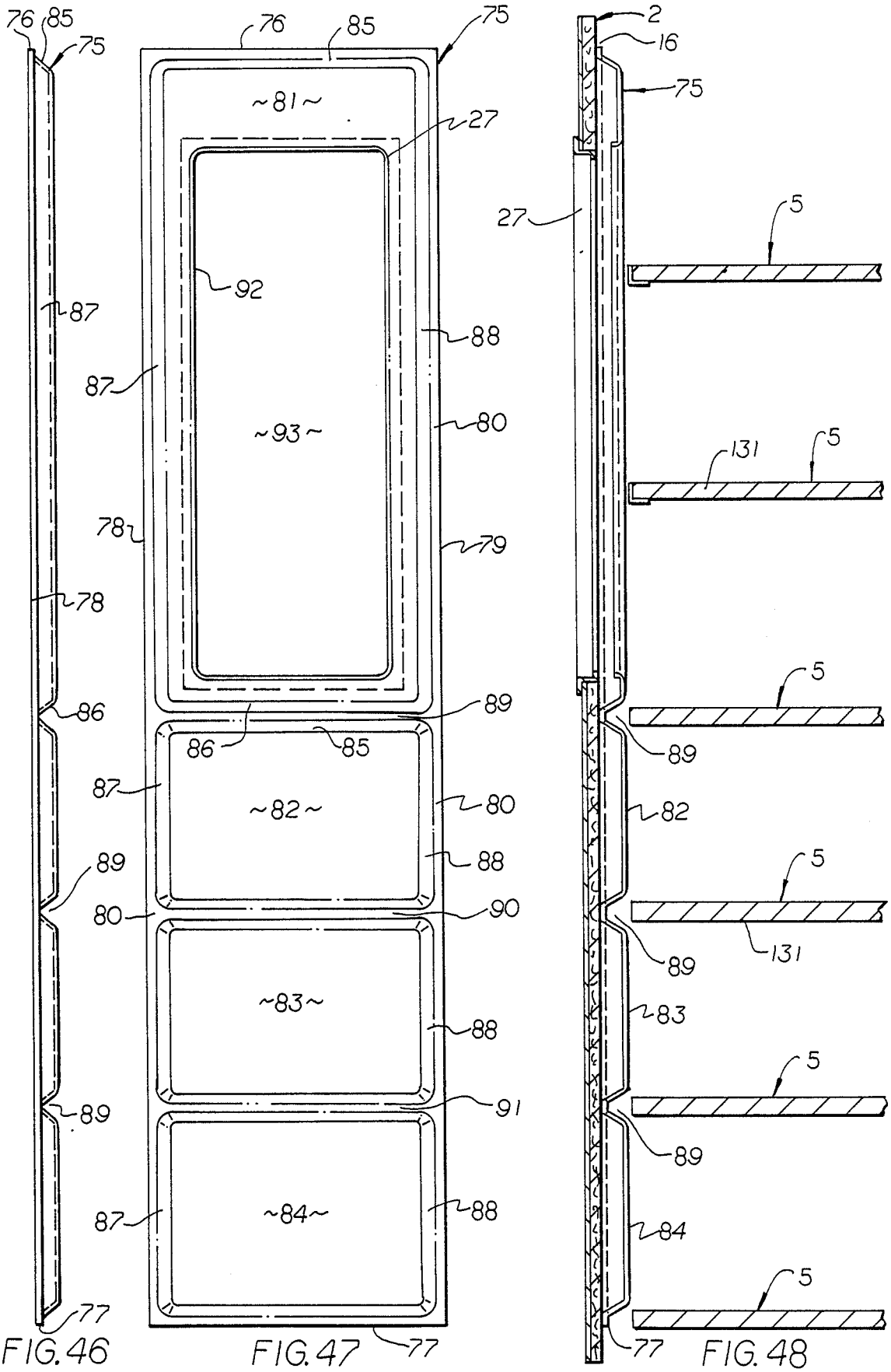
FIG. 46 is a side elevational view of an inner panel portion of the dispensing rack.
FIG. 47 is a front plan view of the inner panel.
FIG. 48 is a fragmentary, vertical cross-sectional view of the dispensing rack, showing the inner panel installed in a mating end panel.

With reference to FIGS. 46–48, end panel 2, as well as end panel 3, includes an inner panel 75, which in the illustrated example, has a substantially rectangular plan configuration with an upper edge 76, a lower edge 77, and opposite side edges 78 and 79. Inner panel 75 has a substantially planar marginal area 80, and a plurality of convex, or inwardly extending panel areas 81–84. Preferably, inner panel 75 has a one-piece, integral construction, comprising a molded sheet of relatively thin plastic, or the like. Each panel area 81–84 has trapezoidally-shaped vertical and horizontal cross-sectional configurations, with raised marginal sidewalls 85–88 extending from the marginal area 80 of inner panel 75. V-shaped grooves 89–91 are formed between the adjacent upper and lower walls 85 and 86 of panels 81–84, and provide visual indicator means for positioning shelf assemblies 5, as described below. In the illustrated example, the uppermost panel area 81 includes a rectangularly shaped aperture 92, which is substantially similar in shape to window aperture 26 in panel 20. A transparent sheet 93 is attached to the interior side of inner panel 75 about the periphery of aperture 92, and forms a windowpane that is laterally aligned with window assembly 27.

Figure 32:
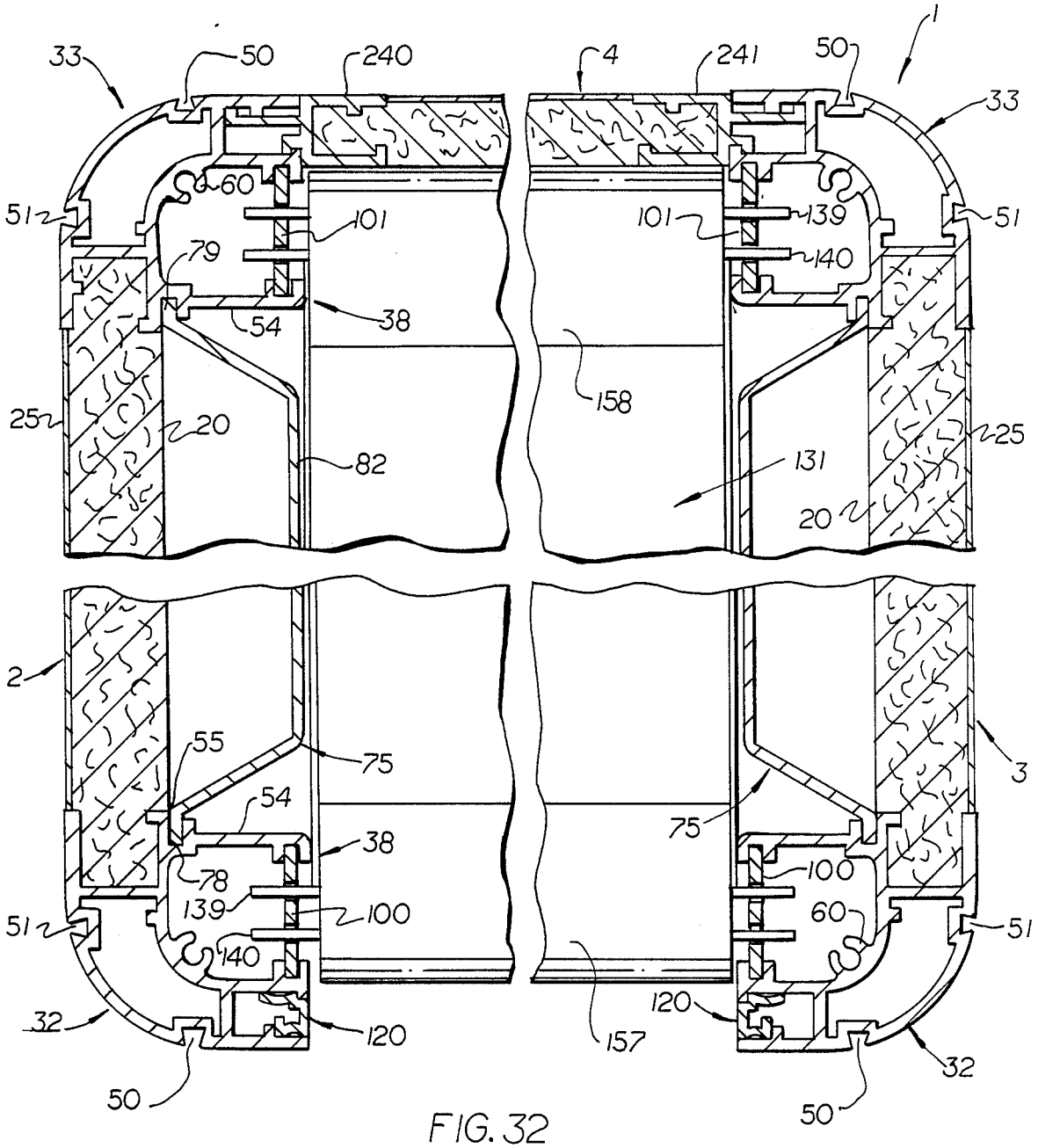
FIG. 32 is a horizontal cross-sectional view of the dispensing rack, showing a shelf supported on a pair of the shelf support bars.
Figure 33:
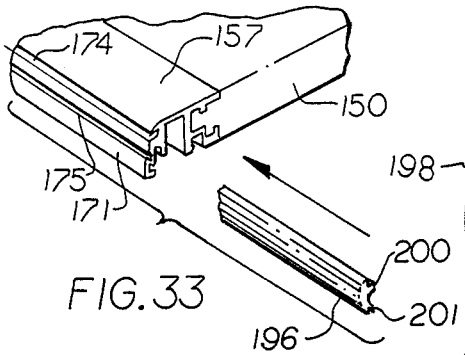
FIG. 33 is a perspective view of a trim strip portion of the present invention, shown exploded away from a corner section of the shelf.
Figure 34:
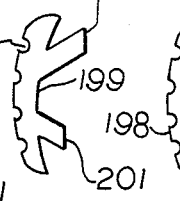
FIG. 34 is a vertical cross-sectional view of the trim strip.
Figure 35:
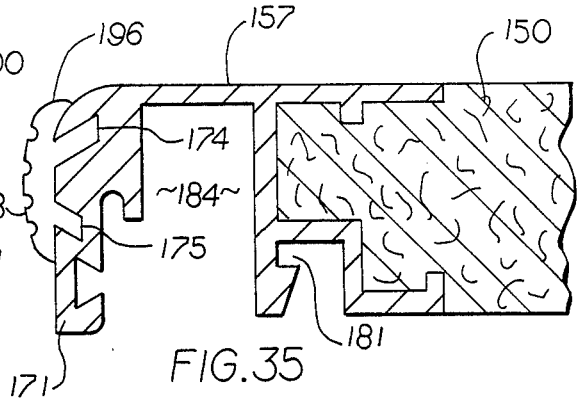
FIG. 35 is a vertical cross-sectional view of the trim strip, shown installed in the channel member of the shelf.
Figure 36:
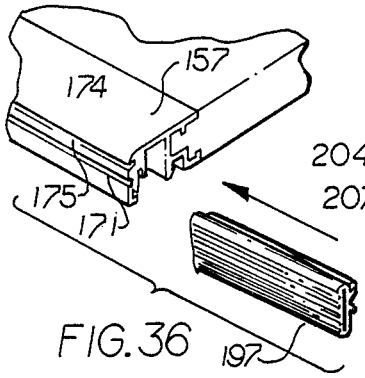
FIG. 36 is a perspective view of a UPC strip portion of the present invention, shown in a closed condition, and exploded away from a corner section of the shelf.
Figure 37:
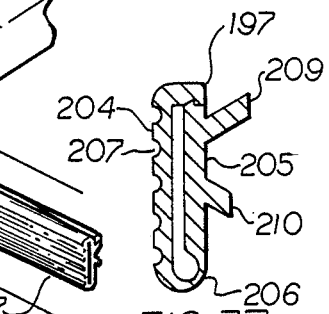
FIG. 37 is a vertical cross-sectional view of the UPC strip shown in the closed condition.
Figure 38:
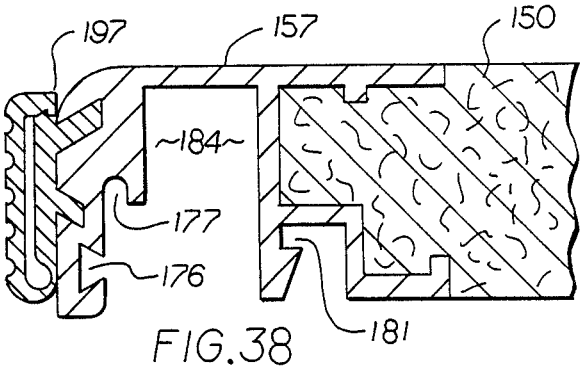
FIG. 38 is a vertical cross-sectional view of the UPC strip, shown in the closed condition and installed in the channel member of the shelf.
Figure 39:
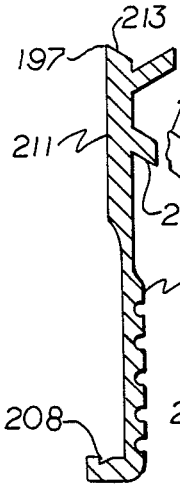
FIG. 39 is a vertical cross-sectional view of the UPC strip, shown in a fully open, folded out condition.
Figure 40:
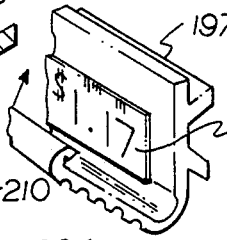
FIG. 40 is a perspective view of the UPC strip, shown in a partially open condition.

As best illustrated in FIG. 32, the side edges 78 and 79 of inner panel 75 are closely received in grooves 55 of corner brackets 32 and 33, so as to mount inner panel 75 on end panel 2. The interior surfaces of panel areas 81–84 are substantially coplanar with first faces 38 of corner brackets 32 and 33, so as to substantially fill or close the void defined between flanges 54 on corner brackets 32 and 33. As a result, objects may be easily inserted and withdrawn from shelf assembly 5, without abutting or being caught by corner brackets 32 and/or 33.

End panel 2 (FIG. 32), as well as end panel 3, includes two slotted uprights 100 and 101. Uprights 100 and 101 are substantially identical, such that for ease of description herein, reference shall be made only to upright 100, with similar parts on upright 101 bearing similar reference numerals. As best illustrated in FIGS. 9–14, upright 100 comprises an elongated, rigid bar, having a substantially rectangular transverse cross-sectional shape, with an upper edge 102, a lower edge 103, and opposite side edges 104 and 105. Upright 100 includes a series of rectangularly-shaped slots 106 and 107 which extend through the front and rear faces of upright 100, and are arranged in laterally aligned side-by-side pairs. Slots 106 and 107 extend along the length of upright 100 in a regularly spaced apart fashion. Each of the slots 106 and 107 has a rectangular elevational shape, defined by an upper edge 108, a lower edge 109, and opposite side edges 110 and 111. Square-shaped apertures 112 also extend through the opposite faces of upright 100, and are spaced at regular intervals along the length of upright 100 to facilitate visual location of shelf assemblies 5. A pair of V-shaped notches 113 and 114 extend through the side edges 104 and 105 of upright 100 adjacent the medial portion of each square aperture 112, and serve to facilitate connecting upright 100 with associated end panel 2.

When assembled, uprights 100 and 101 (FIG. 3) are received in the opposing grooves 56 and 57 of corner brackets 32 and 33, and extend substantially along the entire length thereof. Uprights 100 and 101 are staked in corner brackets 32 and 33 by swagging an indentation 117 (FIG. 14) in the end portion of channel flange 54, which projects inwardly into the inwardly facing one of notches 113 and 114 on upright 100 and 101. The upper edges 102 of uprights 100 and 101 are positioned a spaced apart distance from the upper ends of corner brackets 32 and 33, as shown in FIG. 56, to provide space in which header assembly 6 is mounted to dispensing rack 1, as described in greater detail hereinafter.

Figure 13:
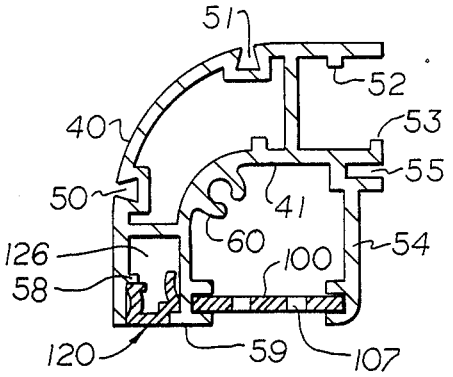
FIG. 13 is a horizontal cross-sectional view of a corner bracket portion of the present invention, with an upright and a cover strip assembled therein.
Figure 10:
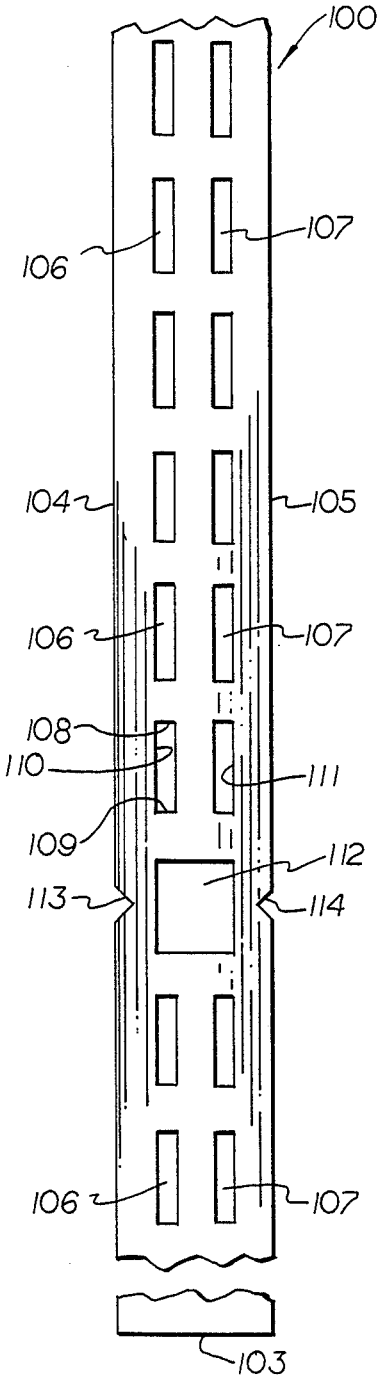
FIG. 10 is a fragmentary, front plan view of the upright.
Figure 12:
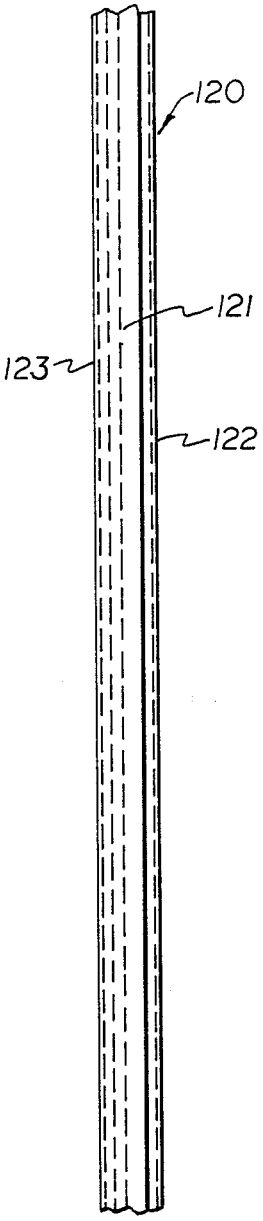
FIG. 12 is a fragmentary, front elevational view of the cover strip.
Figure 14:
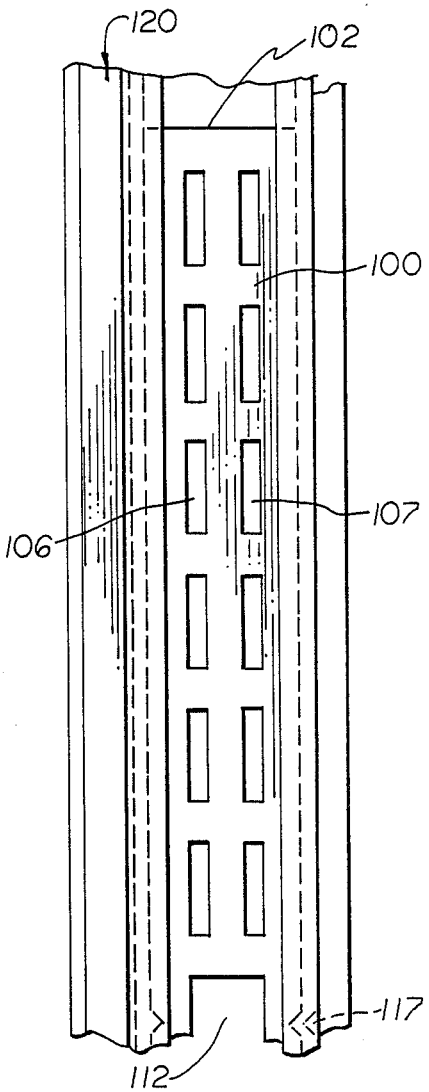
FIG. 14 is a fragmentary, front elevational view of the corner bracket illustrated in FIG. 13.
Figure 15:
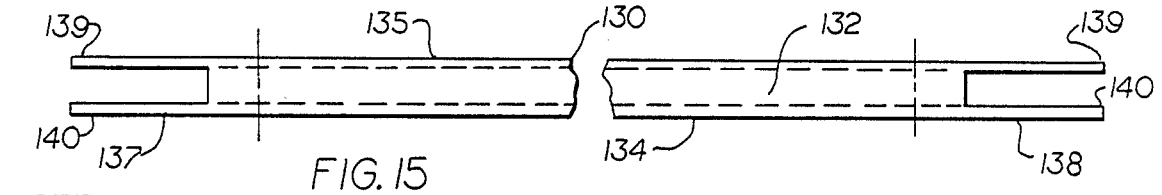
FIG. 15 is a fragmentary, top plan view of a shelf support bar portion of the present invention.
Figure 16:
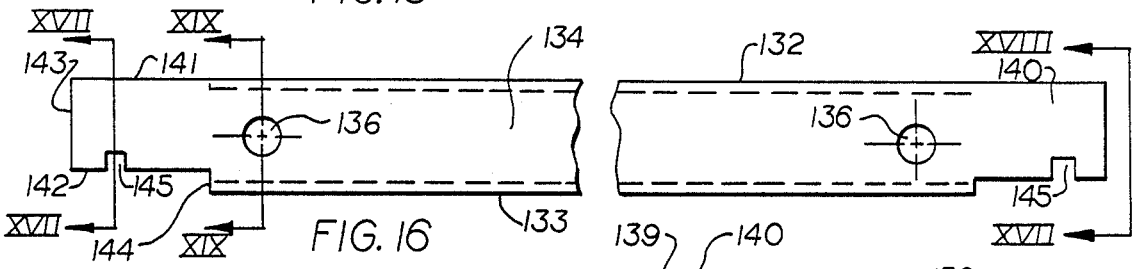
FIG. 16 is a fragmentary, side elevational view of the shelf support bar.
Figures 17, 18, 19, 20, 21:
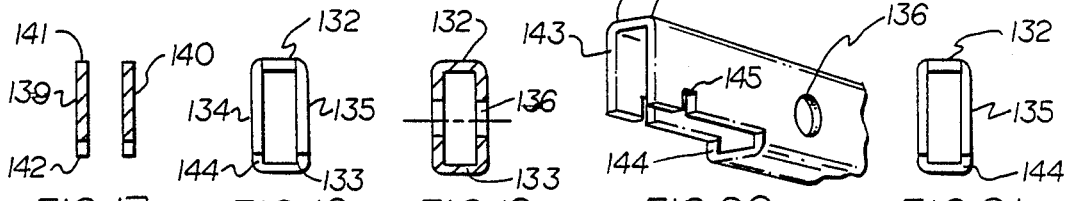
FIG. 17 is a vertical cross-sectional view of the shelf support bar, taken along the line XVII—XVII of FIG. 16.
FIG. 18 is an end elevational view of the shelf support bar, taken from the left-hand end thereof.
FIG. 19 is a vertical cross-sectional view of the shelf support bar, taken along the line XIX—XIX of FIG. 16.
FIG. 20 is a fragmentary, perspective view of the shelf support bar.
FIG. 21 is an end elevational view of the shelf support bar, taken from the right-hand end thereof.

End panel 2 also includes a filler or cover strip 120 (FIGS. 11–14), which is shaped for assembly on the first face 38 of front quarter bracket 32. In the illustrated example, cover strip 120 comprises an elongate channel, constructed from a length of an extruded material, such as aluminum, or the like. Cover strip 120 has a generally U-shaped transverse cross-sectional shape, comprising a web 121, and opposite side flanges 122 and 123. The left-hand flange 123 includes a laterally extending lip 124, and a notch 125 is provided at the intersection of right-hand flange 122 and web 121. As best illustrated in FIG. 13, cover strip 120 is shaped to be closely received within the aperture or void 126 defined between channel walls 40 and 41 at the outer ends 42 and 44 thereof, and closes the same. The lip portion 124 of cover strip 120 engages rib 58 on bracket wall 40, and the notch portion 125 of cover strip 120 is positioned over rib 59 of inner channel wall 41, so as to securely lock cover strip 120 in place. Cover strip 120 is installed by sliding the same longitudinally into void 126. When channel strip 120 is installed in corner bracket 32, the exterior surface of web 121 is substantially flush with the ends 42 and 44 of channel walls 40 and 41, and covers the groove or space formed therebetween, so as to present a neat, finished appearance.

Figure 23:
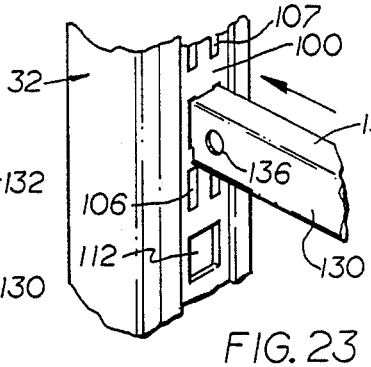
FIG. 23 is a fragmentary, perspective view of the shelf support bar, shown inserted fully into the corner bracket assembly .
Figure 24:
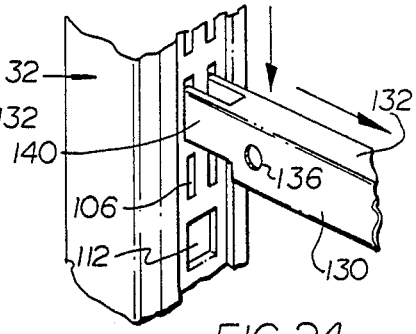
FIG. 24 is a fragmentary, perspective view of the shelf support bar, shown shifted outwardly into a locked position.
Figure 25:
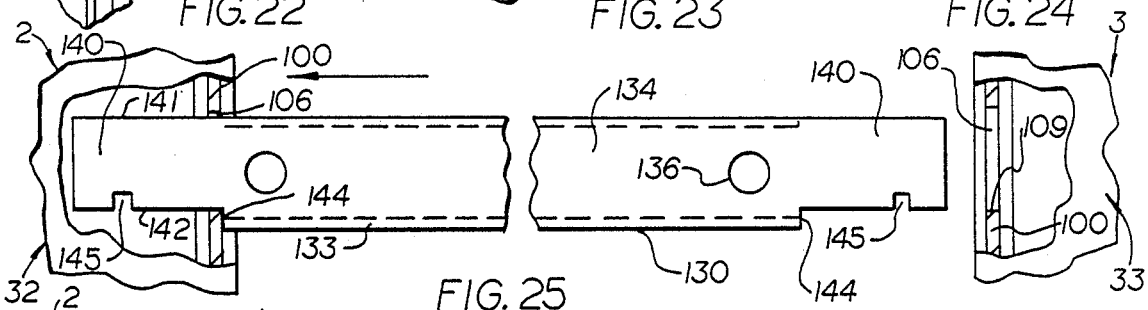
FIG. 25 is a fragmentary, side elevational view of the dispensing rack, with portions thereof broken away to show the shelf support bracket in the fully inserted position shown in FIG. 23.
Figure 26:
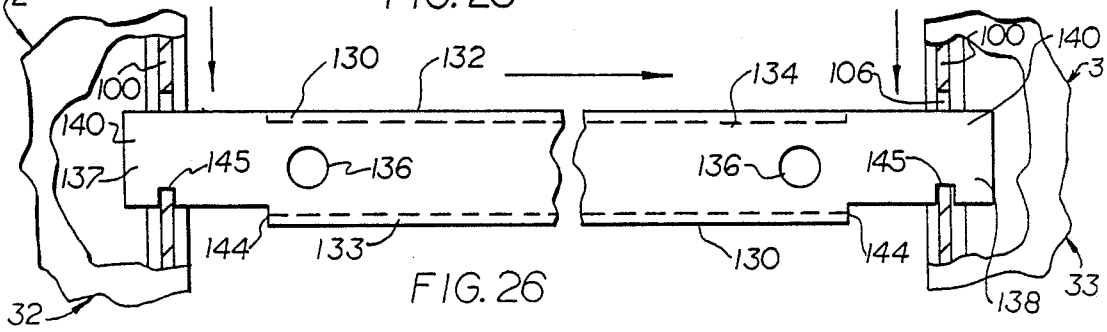
FIG. 26 is a fragmentary, side elevational view of the dispensing rack, with portions thereof broken away to show the shelf support bar in the locked position shown in FIG. 21.

With reference to FIGS. 15–26, shelf assembly 5 comprises a plurality of shelf support bars 130, which extend between opposite end panels 2 and 3, and support shelves 131 (FIGS. 29 and 30) thereon. Shelf support bars 130 (FIGS. 15–26) are substantially identical, and comprise an elongate bar, which in the illustrated example, is constructed from a section of rectangular tubing, having an upper wall 132, a lower wall 133, and opposite sidewalls 134 and 135. A pair of apertures 136 extend through sidewalls 134 and 135 at opposite ends of shelf support bar 130. Shelf support bar 130 has opposite ends 137 and 138, which are specially shaped to facilitate insertion into the slots 106 and 107 of uprights 100 and 101, and to lockingly engage the same. The opposite ends 137 and 138 of shelf support bar 130 are substantially identical, and each comprises a pair of laterally extending prongs 139 and 140, which in the present example, are formed by cutting away the upper wall 132 and the lower wall 133 of shelf support bar, such that prongs 139 and 140 are integral with bar sidewalls 134 and 135. Each of the prongs 139 and 140 has a substantially rectangular front elevational configuration, comprising an upper edge 141, a lower edge 142, and an end edge 143. A vertically extending shoulder 144 is formed at the intersection of lower edge 142 and lower channel wall 133. Each prong 139 and 140 also includes a notch 145, which extends vertically upwardly from the lower edge 142 thereof, and has a width substantially equal to the thickness of uprights 100 and 101. As best illustrated in FIG. 26, the notches 145 on the opposite ends 137 and 138 of shelf support bar 130 are spaced apart a distance that is substantially equal to the distance between the uprights 101 and 100 on the opposite end panels 2 and 3. As best shown in FIG. 25, the height of prongs 139 and 140, as measured between upper and lower edges 141 and 142, is slightly less than the length of upright slots 106 and 107, such that prongs 139 and 140 can be inserted into and closely received within slots 106 and 107. Shoulder 144 provides a stop that abuts the exterior surface of upright 100, and prevents shelf support bar 130 from being inserted further into the associated corner bracket 32. Each shoulder 144 is positioned in a preselected location with respect to the associated notch 145 such that, as in the illustrated example, when the left-hand end 137 of shelf support bar 130 is fully inserted into the slots 106 and 107 of upright 100, the right-hand end 138 of shelf support bar 130 is disposed close to, but spaced slightly apart from a pair of aligned slots 106 and 107 in upright 101 in the opposite end panel 3.

Figure 22:
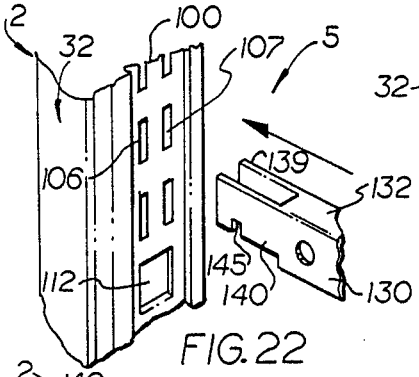
FIG. 22 is a fragmentary, perspective view of the shelf support bar, shown positioned for insertion into the corner bracket assembly.

With reference to FIGS. 22–26, shelf support bars 130 are installed in rack 1 in the following fashion. The assembler selects a pair of upright slots 106 and 107 on one of the end panels, such as the illustrated left-hand end panel 2. When dispensing rack 1 is used for some particular types of product, such as cigarette cartons, rack 1 is typically divided into predetermined or standard volumes or shelf areas, which are leased to certain merchandisers. For a given shelf depth and width, the vertical distance between shelves, or equipment row, is used to measure the product space. Location of shelf assemblies 5 at these standard shelf locations is facilitated by the square apertures 112 in uprights 100 and 101. Hence, the assembler may easily locate the standard location for shelf assembly 5 by setting shelf support bar 130 at a preselected distance from the square upright apertures 112. In the illustrated example, shelf support bar 103 is shown inserted into slots 106 and 107 located two levels above the square apertures 112 in uprights 100 and 101. The assembler aligns prongs 139 and 140 with mating upright slots 106 and 107, as shown in FIG. 22, and inserts shelf support bar 130 into upright 100, until shoulder 144 engages the outer face of upright 100, as shown in FIG. 23. Shoulder 144 provides a positive stop against further insertion of shelf support bar 103. The void or space defined between inner wall 41, and grooves 56 and 57 provides clearance to insertingly receive prongs 139 and 140 therein. As shown in FIG. 24, the right-hand end 138 of shelf support bar 130 is then aligned with a mating pair of slots 106 and 107 in upright 101 on the right-hand end panel 3, which are laterally aligned with the slots 106 and 107 in upright 100 on the left-hand end panel 2. Shelf support bar 130 is then translated laterally in the opposite direction noted by the arrows in FIGS. 24 and 26, along a generally horizontal plane, so that the prongs 139 and 140 on the right-hand end 138 of shelf support bar 130 are inserted into mating slots 106 and 107 on right-hand end panel 3. In the example illustrated in FIGS. 22–26, shelf support bar 130 is translated to the right until both notches 145 are aligned vertically with the lower edges 109 of each of the associated upright slots 106 and 107. Shelf support bar 130 then drops or translates downwardly slightly, as shown by the vertical arrows in FIGS. 24 and 26, until notches 145 are fully engaged over the lower edges 109 of upright slots 106 and 107, as shown in FIG. 26, to positively, yet releasably mount shelf support bar 130 on end panels 2 and 3.

With reference to FIGS. 27–31, shelf assembly 5 also includes a plurality of shelves 131, each of which is supported on a pair of the shelf support bars 130, in the fashion described below. Each shelf 131 comprises a rigid center panel 150, which in the present example, has a substantially rectangular top plan configuration, comprising a front edge 151, a rear edge 152, opposite end edges 153 and 154, and upper and lower faces 155 and 156 respectively. A pair of channels 157 and 158 are attached to and extend along the front and rear edges 151 and 152 of panel 150. The front and rear edges 151 and 152 of panel 150 are substantially identical in shape, and include recessed surfaces 159 and 160 on the upper and lower faces 155 and 156 of panel 150. A pair of grooves 161 and 162 extend longitudinally along the front and rear edges 151 and 152 of panel 150, through recessed surfaces 159 and 160. A rectangularly shaped notch 160 is formed at the lower edge of panel 150, and is defined by mutually perpendicular walls 164 and 165.

Figure 27:
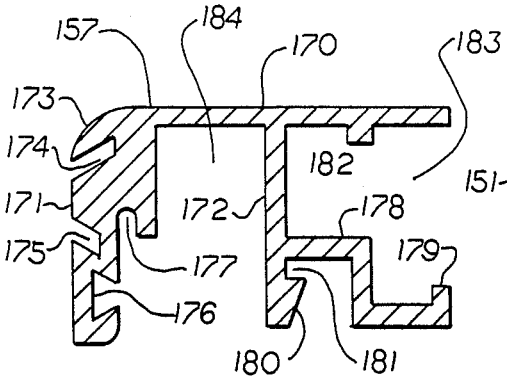
FIG. 27 is a vertical cross-sectional view of a shelf channel portion of the present invention.
Figure 28:
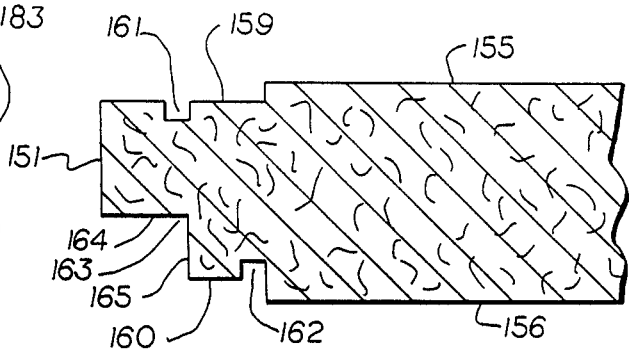
FIG. 28 is a fragmentary, vertical cross-sectional view of a shelf panel portion of the present invention.

Shelf channels 157 and 158 (FIGS. 27–31) are substantially identical in shape, and are preferably constructed from lengths of a rigid, extruded stock material, such as aluminum, or the like. For ease of description, the detailed description herein shall relate only to shelf channel 157, with similar parts on shelf channel 158 bearing the same reference numerals Shelf channel 157 includes an upper flange 170, a forward flange 171, and an intermediate flange 172. The forward flange 171 of shelf channel 157 includes a rounded upper edge 173, and two angled, or mutually inclined grooves 174 and 175. A dovetail-shaped groove 176, and an oblong-shaped groove 177 are formed along the interior surface of forward flange 171, adjacent the lower end thereof. Intermediate flange 172 includes a Z-shaped, laterally extending flange 178, having an inwardly facing rib 179 disposed along the outer, free edge thereof. The lower end of intermediate flange 172 is barb-shaped, with an inclined edge 180, which in conjunction with Z-shaped flange 178, defines a laterally extending groove 181. Upper flange 170 also includes an inwardly facing, laterally extending rib 182 disposed adjacent to the inner edge thereof. The laterally opening space disposed between upper flange 170 and Z-shaped flange 178 defines a groove 183 (FIG. 27). The downwardly opening space disposed between upper flange 170, forward flange 171 and intermediate flange 172 defines a groove 184.

When shelf 131 is assembled, channels 157 and 158 are mounted on the forward and rearward edges 151 and 152 of panel 150 in the following manner. In general, the side edges 151 and 152 of shelf panel 150 are mounted in the grooves 183 of shelf channels 157 and 158. More specifically, channels 157 and 158 are slid longitudinally along panel edges 151 and 152, with ribs 179 and 182 received in mating notches 162 and 161. Forward panel notch 163 is received closely against Z-shaped flange 178. The outer edge 151 of panel 150 is disposed adjacent intermediate channel 172, and the upper and lower inner flanges of channels 157 and 158 are received in the recessed portions 159 and 160 of panel 150, so as to present a smooth, flush, planar surface with the upper and lower surfaces 155 and 156 of panel 150. The length of shelf 131 is selected so that end edges 153 and 154 are disposed closely adjacent to the first faces 38 of the corner brackets 32 and 33 on both of the end panels 2 and 3, as shown in FIG. 32, so that shelves 131 provide lateral, or side-to-side rigidity to dispensing rack 1.

Figure 29:
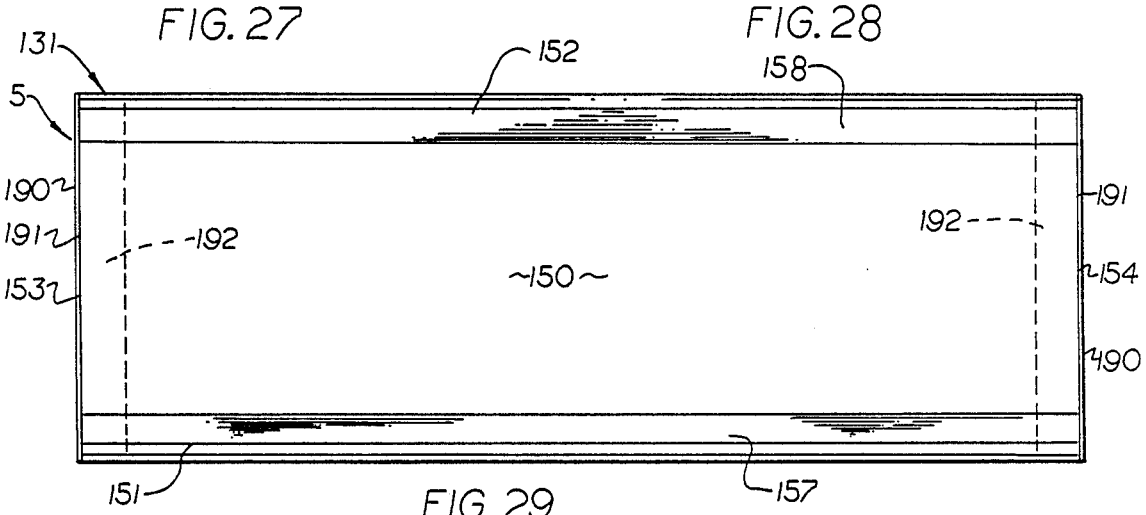
FIG. 29 is a top plan view of a shelf portion of the present invention.
Figure 30:
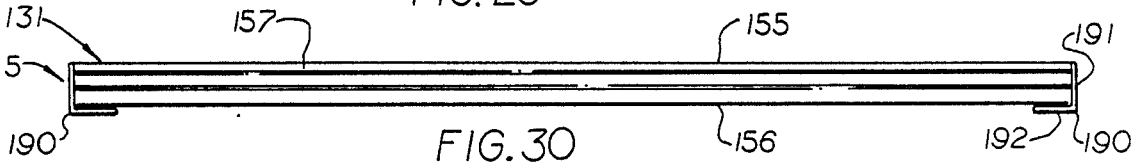
FIG. 30 is a front elevational view of the shelf.

As best illustrated in FIGS. 29 and 30, a pair of L-shaped edge strips 190 may be provided to cover the opposite side edges 153 and 154 of shelf panel 150. In the illustrated example, edge strips 190 are constructed from an extruded, synthetic resin material, such as vinyl, or the like, and have the vertical flanges 191 adhered to the side edges 153 and 154 of shelf panel 150, and the horizontal flanges 192 adhered to the lower face 156 of shelf panel 150 at the opposite ends thereof. Edge strips 190 provide a neat smooth appearance for the side edges of shelves 131, which is particularly important when the end panels 2 and 3 of dispensing rack 1 include window assemblies 27 that expose the end edges of shelves 131.

Figure 31:
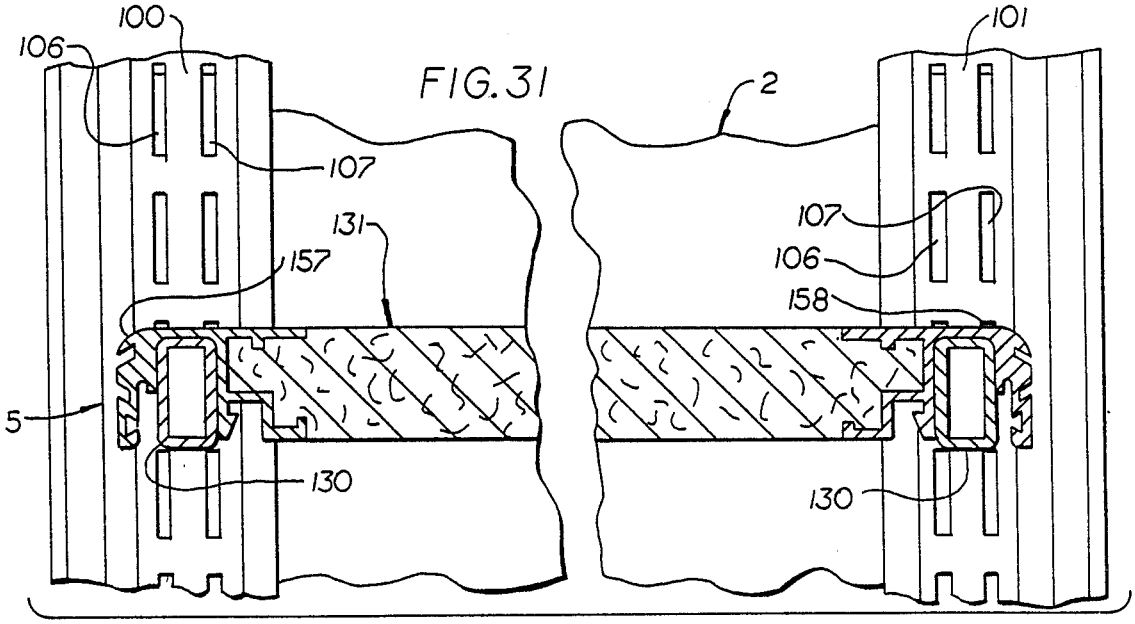
FIG. 31 is a fragmentary, vertical cross-sectional view of the dispensing rack, showing the shelf mounted on a pair of the shelf support bars.

With reference to FIG. 31, shelves 131 are mounted in dispensing rack 1 by a pair of the shelf support bars 130. Two shelf support bars 130 are mounted on uprights 100 and 101 on opposite end panels 2 and 3 in the manner described above. Shelf support bars 130 are normally positioned s that they lie in a substantially horizontal plane When shelves 131 are assembled, the downwardly open groove 184 in shelf channels 157 and 158 are closely received over the associated shelf support bars 130. Shelf support bars 130 are snugly received within channel grooves 184, with the opposite sides thereof firmly engaging the support bar sidewalls 134 and 135, so as to provide fore-to-aft rigidity to dispensing rack 1, as described in greater detail hereinafter.

As best illustrated in FIG. 32, in the assembled condition, the side edges 153 and 154 of shelves 131 are disposed closely adjacent to the center panel areas 82 of inner panel 75. Furthermore, the edge strips 190 on shelves 131 are disposed adjacent to the end surfaces of channel faces 38, so as to present a smooth, substantially continuous shelf area which permits product to be easily inserted into and withdrawn from dispensing rack 1.

With reference to FIGS. 33–43, shelves 131 may also include a trim strip 196 and/or a UPC code strip 197. The illustrated trim strip 196 (FIGS. 33–35) comprises an elongate piece of extruded synthetic resin material, having a ribbed exterior surface 198, and a curved interior surface 199, which is contoured to mate with the exterior surface of the front flange 171 of shelf channel 157. Two angled ribs 200 and 201 extend rearwardly from the interior surface 199 of trim strip 196, and are shaped to be closely received in the mating grooves 174 and 175 of shelf channel 157. Under normal circumstances, trim strip 196 is installed only in the forward edge 151 of shelf 131, since the rearward edge 152 is not exposed. Trim strip 196 provides a protective cover for the front edge of shelf 131, and may be easily removed and replaced.

UPC strip 197 (FIGS. 36–39) is also designed to be mounted on the forward channel 157 of shelf 131, and in the illustrated example is constructed from a length of extruded semi-rigid synthetic resin material. A UPC strip 197 comprises an outer wall 204, and an inner wall 205, which are rotatably and integrally interconnected along a living hinge 206. Outer wall 204 has a ribbed exterior surface 207, and includes a notched latch portion 208 along its free end. Inner wall 205 includes two angled ribs 209 and 210 which are shaped for close reception in the grooves 174 and 175 of shelf channel 157. The upper edge 213 of inner wall 205 is beveled, and adapted to engage the latch portion 208 of outer wall 204 to form a snap lock therebetween when the UPC strip is in the closed position illustrated in FIGS. 36–38. The interior surface 211 of inner Wall 205 is adapted to display indicia, which in the illustrated example, comprises a price sticker 212, which identifies the price of the goods displayed on the shelf directly above, as well as the associated UPC bar code.

UPC strip 197 is installed in the front channel 157 of shelf 131 by inserting ribs 209 and 210 in associated grooves 174 and 175. When UPC strip 197 is in the open position illustrated in FIG. 39, price sticker 212 is displayed. UPC strip 197 is closed by simply rotating outer wall 204 about living hinge 206, until latch 208 snaps onto the beveled upper edge 213 of inner wall 205. When UPC strip is in the closed condition shown in FIGS. 36–38, outer wall 204 covers price sticker 212.

Figure 41:
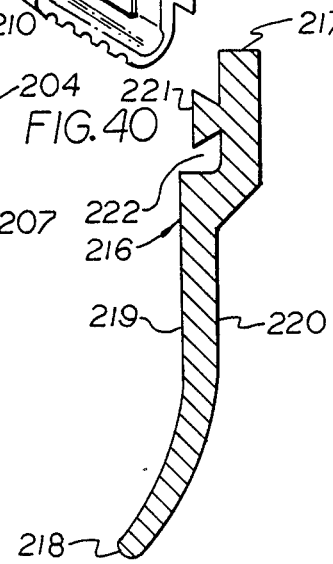
FIG. 41 is a vertical cross-sectional view of a toe guard strip portion of the present invention.
Figure 42:
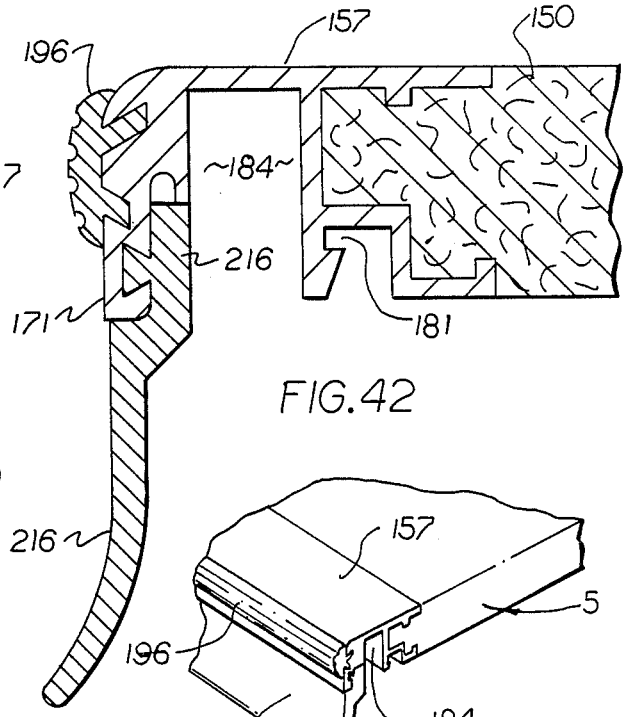
FIG. 42 is a vertical cross-sectional view of the toe guard strip, shown attached to the channel member of the shelf.
Figure 43:
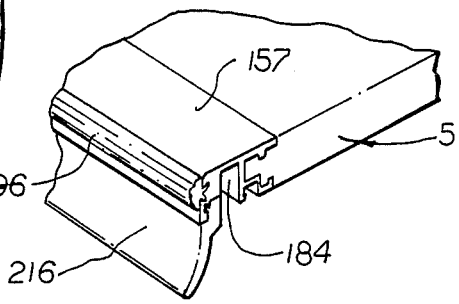
FIG. 43 is a fragmentary, perspective view of the toe guard strip shown installed in the channel member of a shelf.

Shelf assembly 5 also includes a toe guard strip 216 (FIGS. 41–43). The illustrated toe guard strip 216 is preferably constructed from a length of extruded, semi-rigid synthetic resin material, and is in the nature of a slightly curved, panel-shaped flap, having a flat upper edge 217, a rounded lower edge 218, and opposite side faces 219 and 220. Toe guard strip 216 curves forwardly toward lower edge 218, and includes a dovetail-shaped rib 221 extending longitudinally along adjacent upper edge 217, which is adapted for close reception in the mating groove 176 of the front shelf channel 157, as shown in FIG. 42. Toe guard strip 216 includes recess 222 directly below rib 221, so that the exterior face 219 of toe guard strip 216 is substantially flush with the forward flange 171 of shelf channel 157. The upper edge 217 of toe guard strip 216 abuts the lower, inner edge of channel 157, so as to permit additional flexure of toe guard strip 216 in shelf channel 157. Toe guard strip 216 is normally mounted in the lowermost one of the shelves 131 of dispensing rack 1, and covers the space between that shelf and the floor, as best illustrated in FIG. 45.

With reference to FIGS. 44 and 45, shelves 131 are installed in dispensing rack 1 in the following fashion. For each shelf 131, a pair of shelf support bars 130 are mounted in the uprights 100 and 101 of each end panel 2 and 3, in the manner described above. The lowermost shelf 131 is provided with a toe guard strip 216 in its forward channel 157. With the shelf 131 tilted or angled diagonally, as illustrated in FIG. 44, shelf 131 is inserted between end panels 2 and 3, until the rear channel 158 of shelf 131 is disposed adjacent to the rear of dispensing rack 1. The downwardly opening grooves 184 on shelf channels 157 and 158 at the downwardly tilted end of shelf 131 are aligned with and inserted over the associated shelf support bars 130. As previously noted, the opposite end of shelf 131 is then rotated downwardly, until it bottoms out against shelf support bars 130. The close fitting relationship of shelf channels 184 on shelf support bars 130 provides very secure fore-to-aft rigidity for rack 1. Furthermore, the close spacing of the shelf ends 153 and 154 adjacent to the associated corner brackets 32 and 33 of end panels 2 and 3 provide substantial side-to-side or lateral rigidity to rack 1. Additional shelves 131 are installed on mating pairs of shelve support bars 130 in a manner similar to the procedure outlined above.

With reference to FIGS. 49–55, back panels 4 extend between end panels 2 and 3 along the rearward edges thereof, and close off the rear of dispensing rack 1. In the illustrated example, back panels 4 are substantially identical in shape, and each comprises a rigid center panel 228, having a substantially rectangular front elevational shape, comprising an upper edge 229, a lower edge 230, opposite side edges 231 and 232, and opposite faces 233 and 234. The illustrated back panel 228 is constructed from a dense particle board, and includes two sheets or layers 235 of an imperforate laminate, such as vinyl or the like adhered to both faces 233 and 234 of panel 228. The side edges 231 and 232 of panel 228 include recessed areas 236 and 237, with inwardly facing, staggered grooves 238 and 239. A pair of side channels 240 and 241 are mounted along the side edges 231 and 232 of back panel 228, and include a U-shaped body 242 having inwardly facing ribs 243 and 244 positioned to be closely received in the associated grooves 238 and 239 of back panel 228. Side channels 240 and 241 also include two laterally extending flanges 245 and 246, which include outwardly protruding ends or ribs 247 and 248. Flanges 245 and 246 are shaped to be closely received within the grooves 63 of the rearward corner brackets 33 on end panels 2 and 3. When assembled, flange end 247 is positioned between rib 58 and web 49, and flange end 248 is positioned on the inward side of rib 59, which is captured therein against the adjacent portion of channel 242. In this fashion, back panels 4 are slidingly received in the grooves 63 of rear corner brackets 33 of both end panels 2 and 3.

The upper and lower edges 229 and 230 (FIGS. 50–52) of back panel 228 also include recess side faces 252–253 and 254–255, as well as staggered grooves 256–257 and 258–259. A female V-channel 260 is attached to the upper edge 229 of back panel 228, and a male V-channel 261 is attached to the lower edge 230 of back panel 228. Both the female and male V channels 260 and 261 include U-shaped bodies, comprising webs 264–265, and opposite flanges 266–269. Inwardly facing ribs 270–273 are positioned in a staggered fashion on channels 260 and 261, and are closely received in grooves 256–259. The web 264 of female V-channel 260 includes an upwardly facing, wedge-shaped groove 274 defined by trapezoidally arranged faces 275–277. A semi-cylindrically shaped groove of recess 278 extends longitudinally along the face 277 of groove 274 for purposes to be described in greater detail hereinafter. The web portion 265 of male V-channel 261 includes a downwardly protruding rib 279, defined by trapezoidally arranged faces 280–282. A semi-cylindrically shaped rib or ridge 283 is disposed longitudinally along face 282 of rib 279, and is shaped to be closely received within the mating recess 278 in groove 274 to form a snap lock between vertically stacked back panels 4.

Back panels 4 are assembled in dispensing rack I in the following fashion. One of the end panels, such as left-hand end panel 2, is placed exterior side down on a floor surface. The lowermost back panel 4 is then installed on the rear corner bracket 33 of end panel 2 by inserting the left-hand side flanges 245 and 246 of back panel 4 into the groove 63 of corner bracket 33 from the bottom end thereof. The female V-channel 260 on back panel 4 should be facing the upper end on end panel 2. In the event that casters or feet are to be assembled on dispensing rack 1, such casters and/or feet are then fixed in place on the lower ends of corner brackets 32 and 33. End panel 2, with lowermost back panel 4 attached thereto, is then rotated upwardly to an upright position, such that back panel 4 assumes its normal, substantially horizontal orientation. The right-hand end panel 3 is then assembled onto the right-hand side of back panel 4 by lifting right-hand end panel 3 upwardly, and lowering the same downwardly, with groove 63 on the right-hand rear corner channel of end panel 3 received over flanges 245 and 246 of the right-hand, back panel channel 242, until right-hand end panel 3 engages the floor. A second back panel 4 is then assembled on dispensing rack 1 by lifting the same above the upper ends of the rear corner brackets 33, and sliding the same downwardly along grooves 63, until the male V-channel 261 in the upper back panel 4 abuts the female V-channel 260 in the lowermost back panel 4. Downward force is then applied to the upper back panel 4, thereby causing the ridge 283 on male V-channel 261 to snap into the mating recess 278 on female V-channel 260, so as to releasably, structurally interconnect the same, and simultaneously form a seal therebetween. Additional back panels 4 are assembled on the rear corner brackets 33 in a similar fashion, until the entire back of rack 1 has been closed. As best shown in FIG. 49, a U-shaped back panel cover strip 268 is provided to cover the female V-channel 260 on the uppermost back panel 4.

With reference to FIGS. 56–60, header assembly 6 is mounted in the forward corner brackets 32 of end panels 2 and 3 at the uppermost ends thereof. In the illustrated example, header assembly 6 comprises a pair of upper and lower channels 290 and 291, in which a signage panel 292 is mounted Header channels 290 and 291 are substantially identical, and are preferably constructed from lengths of an extruded rigid material, such as aluminum channel, or the like. Channels 290 and 291 each have a generally C-shaped configuration, comprising an outer flange 293, an inner flange 294, and a web 295 extending along the forward edges of flanges 293 and 294. The inner flanges 294 include an inwardly facing groove 296 in which the upper and lower edges of signage panel 292 are received and retained. Outer flanges 293 include a barb-shaped groove 297 and a ledge 307 adjacent the rearward edges thereof for purposes to be described below. A pair of vertically aligned fastener bosses 298 and 299 are provided on flanges 293 and 294 respectively, adjacent medial portions thereof, and facilitate mounting a pair of slides 300 and 301 to the left and right-hand sides of header assembly 6. Slides 300 and 301 are substantially identical, and as best illustrated in FIG. 57, have a wing-like construction, comprising a flat central web 302, with laterally bent, outwardly extending flanges 303 and 304. Each slide 300 and 301 includes four fasteners 305 extending laterally through mating apertures (not shown) therein, and have their ends engaged in fastening bosses 298 and 299. Slides 300 and 301 are spaced apart so as to be slidingly received in the grooves 56 and 57 on the forward corner brackets 32 of end panels 2 and 3.

The illustrated single panel 292 has a rectangular plan configuration, with marginal edges captured between upper and lower channels 290 and 291, and slides 300 and 301. Single panel 292 is rigid, and is adapted to display indicia thereon, as illustrated in FIG. 1. Single panel 292 is preferably constructed from a sheet of lightweight, durable material, such as a rigid synthetic resin material.

Header assembly 6 is installed in rack 1 by inserting slides 300 and 301 into channel grooves 56 and 57, and translating the same downwardly until the lower ends 306 of slides 300 and 301 abut the upper ends 102 of uprights 100 and 101. The height of uprights 100 and 101 is selected so that when header assembly 6 is assembled, the upper surface of header channel 293 is substantially flush with the upper end edges cf forward corner brackets 32.

Figure 61:
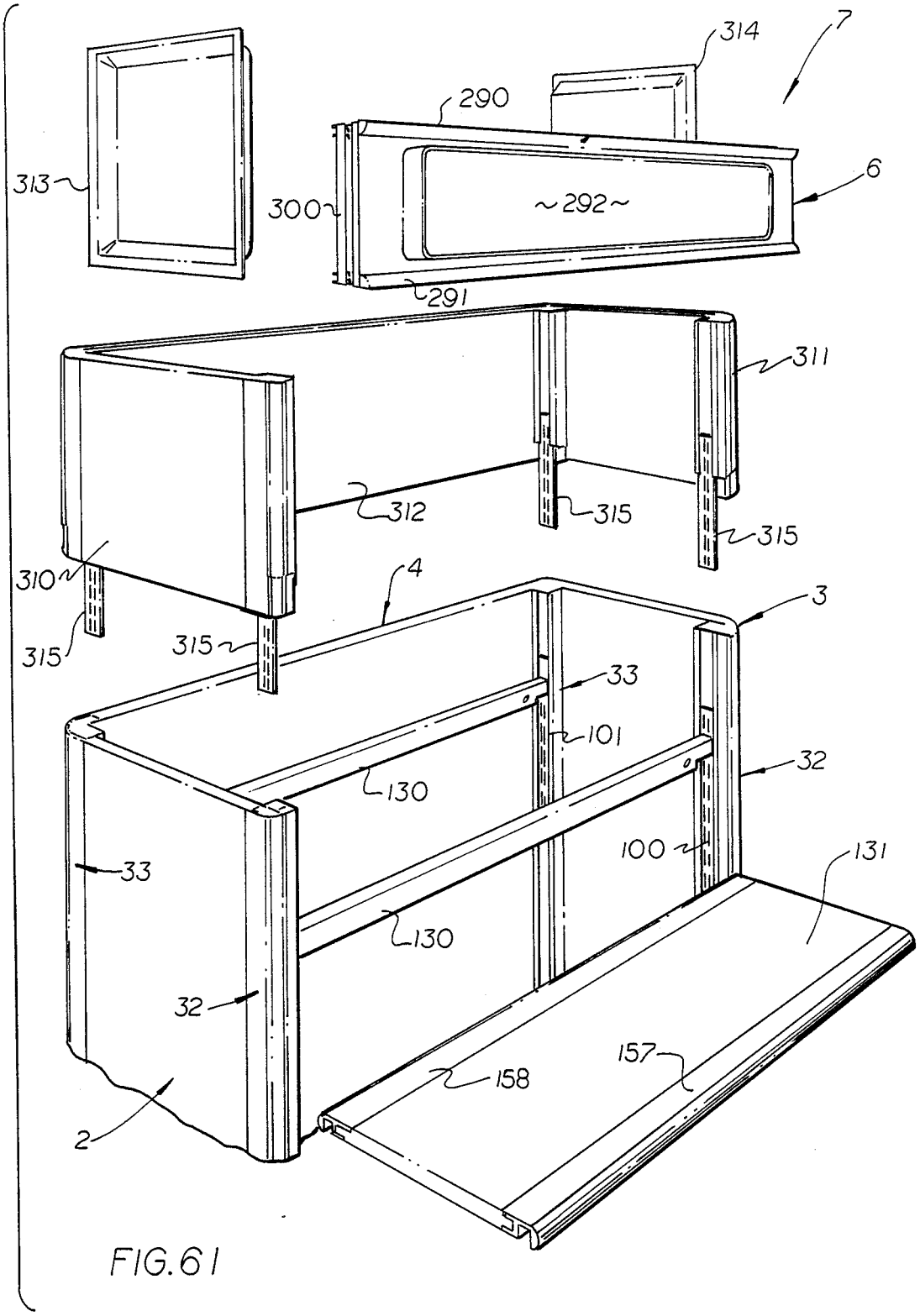
FIG. 61 is an exploded, perspective view of a shelf add-on kit for the dispensing rack.

With reference to FIG. 61, add-on shelf kit 7 comprises a pair of add-on end panels 310 and 311, an add-on back panel 312, a pair of add-on inner panels 313 and 314, four upright extenders 315, as well as an additional shelf 131, and two shelf support bars 130. Add-on end panels 310 and 311 are substantially identical to end panels 2 and 3, except that their height is greatly reduced, providing only that additional height necessary for one more shelf 131. Add-on back panel 312 is substantially identical to back panel 4, except that its height is such as to close off only the rear section of the add-on end panels 310 and 311. Add on inner panels 313 and 314 are substantially identical to inner panels 75, except that their height is substantially coextensive with that of add-on end panels 310 and 311. Upright extenders 315 are substantially identical in construction to uprights 100 and 101, but their height is only substantially equal to the height of add-on end panels 310 and 311. The shelf 131 and shelf support bars 130 associated with add-on shelf kit 7 are identical to the previously described parts.

To assemble add-on shelf kit 7, header assembly 6 is first removed from the forward corner brackets 32, by sliding the same upwardly therefrom. Upright extenders 315 are then inserted into grooves 56 and 57 of each of the corner brackets, until the lower ends of upright extenders 315 abut the upper ends 102 of uprights 100 and 101. Two add-on shelf support bars 130 are mounted in the upper ends of uprights 100 and 101, and add-on shelf 131 is then mounted thereon in the manner discussed above. The slides 300 and 301 on header assembly 6 are then inserted into grooves 56 and 57 of the forward corner brackets 32 on add-on end panels 310 and 311.

It is to be noted that by virtue of the modular design of dispensing rack 1, many different shapes and configurations can be made using common parts. For example, different height dispensing racks 1 can be easily constructed by providing alternate end panels 2 and 3 of varying heights. In such embodiments all the parts of the new end panels 2 and 3 would be identical, except that they would be either shorter or longer. The same back panels 4, shelf assemblies 5, header assembly 6, and other parts used with rack would also be used in such alternate embodiments. In like manner, both single depth and double depth dispensing racks 1 can be constructed by providing end panels 2 and 3, and shelves 131 of different widths. Such modified versions of dispensing rack 1 would also incorporate many common parts, such as corner brackets 32 and 33, back panels 4, shelf support bars 130, header assembly 6, etc., so as to greatly reduce manufacturing costs, yet maximize versatility. As another example, dispensing racks 1 with different widths can also be constructed by simply providing alternate shelf assemblies 5, and back panels 4. Still further variations and modifications to dispensing rack 1 are possible, as would be appreciated by one having ordinary skill in the art.

Figures 62, 63, 64, 65:
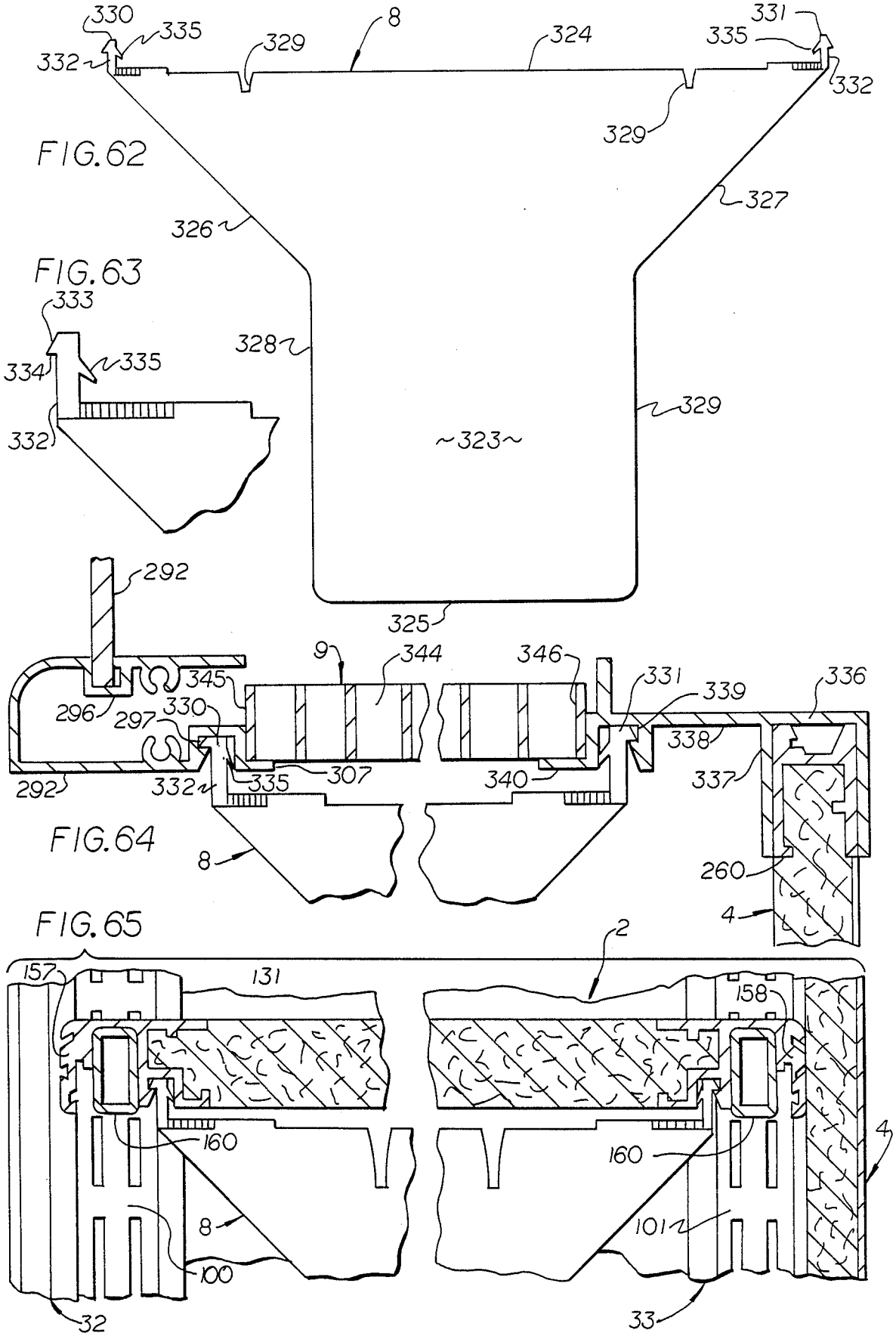
FIG. 62 is a side elevational view of a row divider portion of the dispenser rack.
FIG. 63 is an enlarged, fragmentary view of the row divider.
FIG. 64 is a fragmentary, vertical cross-sectional view of an upper portion of the dispensing rack, showing the row divider and a light diffuser panel installed therein.
FIG. 65 is a fragmentary, vertical cross-sectional view of the dispensing rack, showing the row divider supported by one of the shelves.
Figure 66:
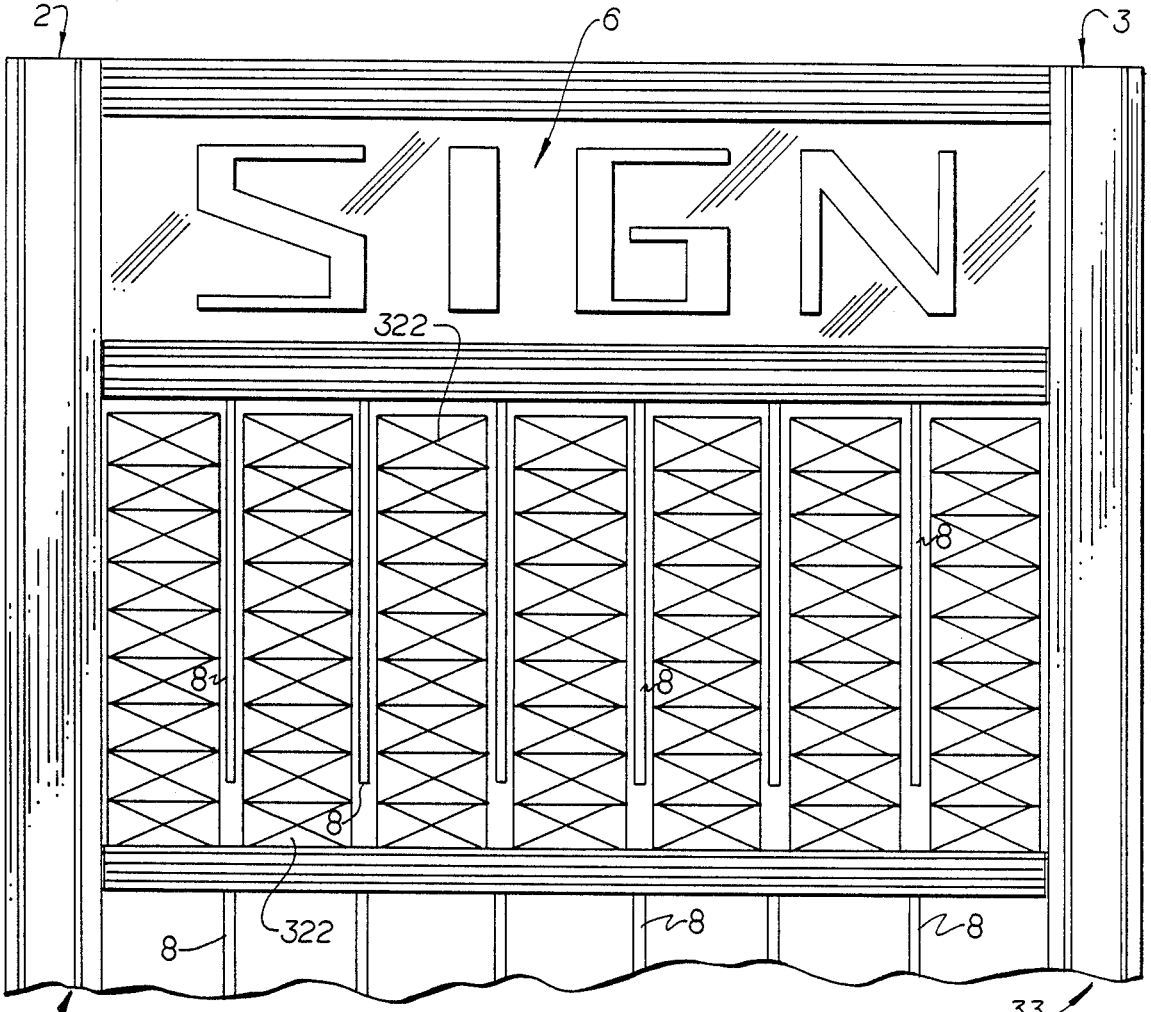
FIG. 66 is a front elevational view of the dispensing rack, showing a plurality of row dividers installed therein in a side-by-side fashion.

As best illustrated in FIGS. 62–66, row dividers 8 are provided between adjacent shelves 131 to separate and stabilize adjacent vertically stacked rows of articles, such as the cigarette cartons 322 illustrated in FIG. 66. In the illustrated example, each row divider 8 comprises a flat panel 323 constructed from a relatively thin sheet of semi-rigid synthetic resin material, and has a generally Y-shaped side elevational configuration, comprising an upper edge 324, a lower edge 325, upper inclined side edges 326 and 327, and lower straight side edges 328 and 329. The upper edge 324 of Y-shaped panel 323 includes a pair of hooks 330 and 331 at opposite ends thereof, which are shaped to be closely received in mating grooves. When row divider 8 is supported by a shelf 131, as shown in FIG. 65, hooks 330 and 331 are received in the barb-shaped grooves 181 in the forward and rearward channels 157 and 158 of shelf 131. Hooks 330 and 331 each include an upwardly extending arm 332, with outwardly extending points defined by intersecting edges 333 and 334. A resiliently flexible retainer tab 335 extends inwardly from the rear surface of arm 332 at a downwardly inclined angle, and functions as a leaf spring, as described in greater detail below. In the illustrated example, a pair of notches 329 are provided in the upper edge 324 of Y-shaped divider panel 323 to render panel 323 more vertically flexible to facilitate inserting panel hooks 330 and 331 in mating channel grooves 181. The height of Y-shaped panel 323, as measured between upper and lower edges 324 and 325, is substantially commensurate with the vertical distance between adjacent shelves 131. The depth of divider panel 323, as measured between opposite side edges 326 & 327 and 328 & 329, is preferably less than the depth of at least the lower shelf 131, such as the edges 326–329 of divider panel 323 are either flush with or recessed inwardly from the forward and rearward channels 157 and 158 of shelf 131.

The uppermost row dividers 8 (FIG. 64), which are positioned to separate and stabilize cigarette cartons 322 disposed on the uppermost shelf 131, are suspended from header assembly 6 at their front edges, and by a special support strip 336 at their rear edges. The forward hooks 330 on row dividers 8 are received in the barb-shaped groove 297 on the lower channel 291 of header assembly 6. Light diffuser panel 9 is abuttingly supported on the ledge 307 of lower header channel 291. Support strip 336 is positioned on the uppermost back panel 4, and includes an inverted U-shaped body 337, and a laterally extending arm 338. The support strip body 337 is received over and mounted on the female V-channel 260 of the uppermost back panel 4. Support strip arm 338 extends forwardly from back panel 4, and includes a barb-shaped groove 339, and an L-shaped ledge 340. The rearward hooks 331 of the uppermost row dividers 8 are mounted in groove 339 of support strip 336. The rearward edge of light diffuser panel 9 is supported on the ledge 340 of support strip 336.

As best illustrated in FIG. 66, a plurality of row dividers 8 are suspended or hung from header channel 291 and support strip 336 at the uppermost shelf, and from grooves 181 of shelves 131. Row dividers 8 slide laterally in their mating channels to permit quick and easy adjustment to accommodate the width of the articles stored in rack 1. As best shown in FIG. 66, when cigarette cartons 322 are stacked in adjacent, vertical rows, with dividers 8 disposed therebetween, divider panels 8 not only divide the adjacent rows of articles such that they can be easily inserted into rack 1, without catching or binding on adjacent articles, but they also prevent the articles from toppling or tipping sideways.

In operation, row dividers 8 are assembled in dispensing rack 1 in the following fashion. When row dividers 8 are to be hung from a shelf assembly 5, as shown in FIG. 65, the hooks 330 and 331 of each row divider 8 are positioned directly beneath the front and rear channel grooves 181 at the approximate side-to-side position at which the row divider 8 is required. Next, hooks 330 and 331 are sequentially inserted upwardly into front and rear channel grooves 181. During the insertion of hooks 330 and 331, the forward, inclined surface 333 of each hook abuts the mating, inclined surface 180 of the shelf channel 157, thereby compressing or flattening resilient retainer tab against the mating surface of Z-flange 178. As each hook surface 334 clears the inclined surface 180 of channel 157, the associated retainer tab 335 resiliently urges hooks 130 and 430 laterally into channel grooves 181, and securely retains the same therein. In this manner, row dividers 8 cannot be inadvertently removed or dislodged from dispensing rack 1, even if the row dividers are hit or jostled during loading or unloading of dispensing rack 1. Z-flange 178 may be provided with laterally extending rib (not shown) extending from the lower surface thereof toward inclined surface 180 to provide positive engagement with retainer tab 335.

Figure 67:
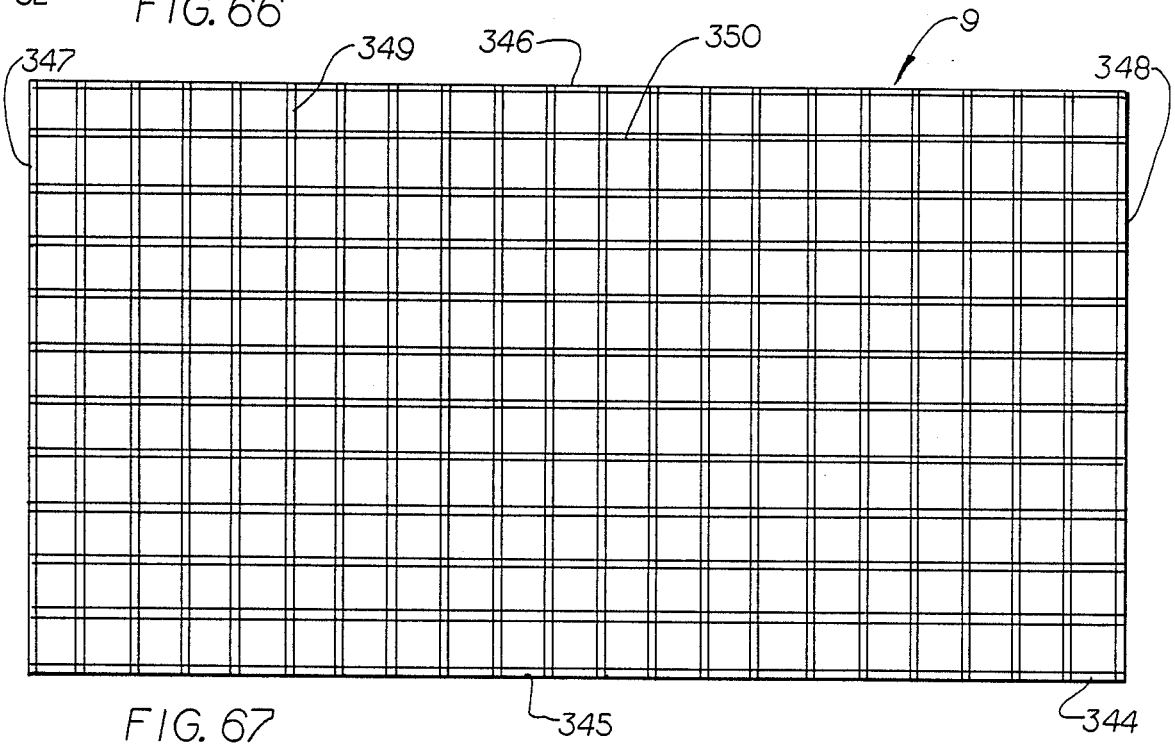
FIG. 67 is a top plan view of the light diffuser panel.

With reference to FIG. 67, light diffuser 9 is installed in the top of dispensing rack 1 to cover the upper end thereof, and presents a neat, closed, finished appearance, particularly from the interior of dispensing rack 1. In the illustrated example, light diffuser 9 comprises a panel-shaped grid 344 having a substantially rectangular plan configuration, with a forward edge 345, a rearward edge 346, and opposite side edges 347 and 348. Panel 344 has a substantially conventional construction, comprising crisscrossing ribs 349 and 350, which intersect to form square apertures therebetween. The forward edge 345 of light diffuser panels 344 is supported o the ledge 307 (FIG. 64) of header channel 292. The rearward edge 346 of light diffuser panel 344 is supported on the ledge 340 of support strip 336. The side edges 347 and 348 of light diffuser panel 344 extend between the interior sides of inner panels 75 on end panels 2 and 3, and are not normally independently supported.

With reference to FIGS. 68–77, shelf jack 10 provides vertical support between adjacent shelves 131. In the illustrated example, shelf jack 10 comprises a one piece hanger bracket 355 and jack plate 356, a sleeve-shaped jack housing 357, and two jack pins 358. Hanger bracket 355 comprises an elongated rigid arm, which extends along the upper edge of jack plate 356. Hanger bracket 355 protrudes outwardly from the opposite sides of jack plate 356, and includes hook strips 359 and 360 at opposite ends thereof, which are received in the barb-shaped grooves 181 of the shelf channels 157 and 158. The illustrated hanger bracket 355 has an I-shaped top plan configuration, and is molded integrally with jack plate 356.

Jack plate 356 comprises a flat rigid body, having two sets of apertures 368 and 369 extending laterally therethrough along opposite sides of jack plate 356 in vertically aligned columns. Apertures 368 and 369 are sized to receive jack pins 358 therethrough, as described in greater detail hereinafter. Jack plate 356 also includes a groove in the nature of a keyway 370, which extends vertically through the central portion of jack plate 356.

Jack housing 357 has a hollow, sleeve-shaped body comprising opposite sidewalls 374 and end walls 375. A rib 376 is positioned between sidewalls 374 along the medial portion thereof, and forms a rib or key in which keyway 370 is received. Jack housing sidewalls 374 and 375 also include two pairs of apertures 377 and 378 therethrough, which are aligned with the apertures 368 and 369 respectively in jack plate 356, and are adapted to receive jack pins 358 therein. The pin apertures 368 and 369 associated with sidewall 375 of jack housing 357 are enlarged with respect to the mating apertures in sidewall 374, and include a pair of notches 365 (FIG. 77) arranged in a diametrically opposing fashion to facilitate the mounting of jack pins 358, as discussed below.

Figures 68, 69, 70, 71, 72, 73, 74, 75, 76, 77:
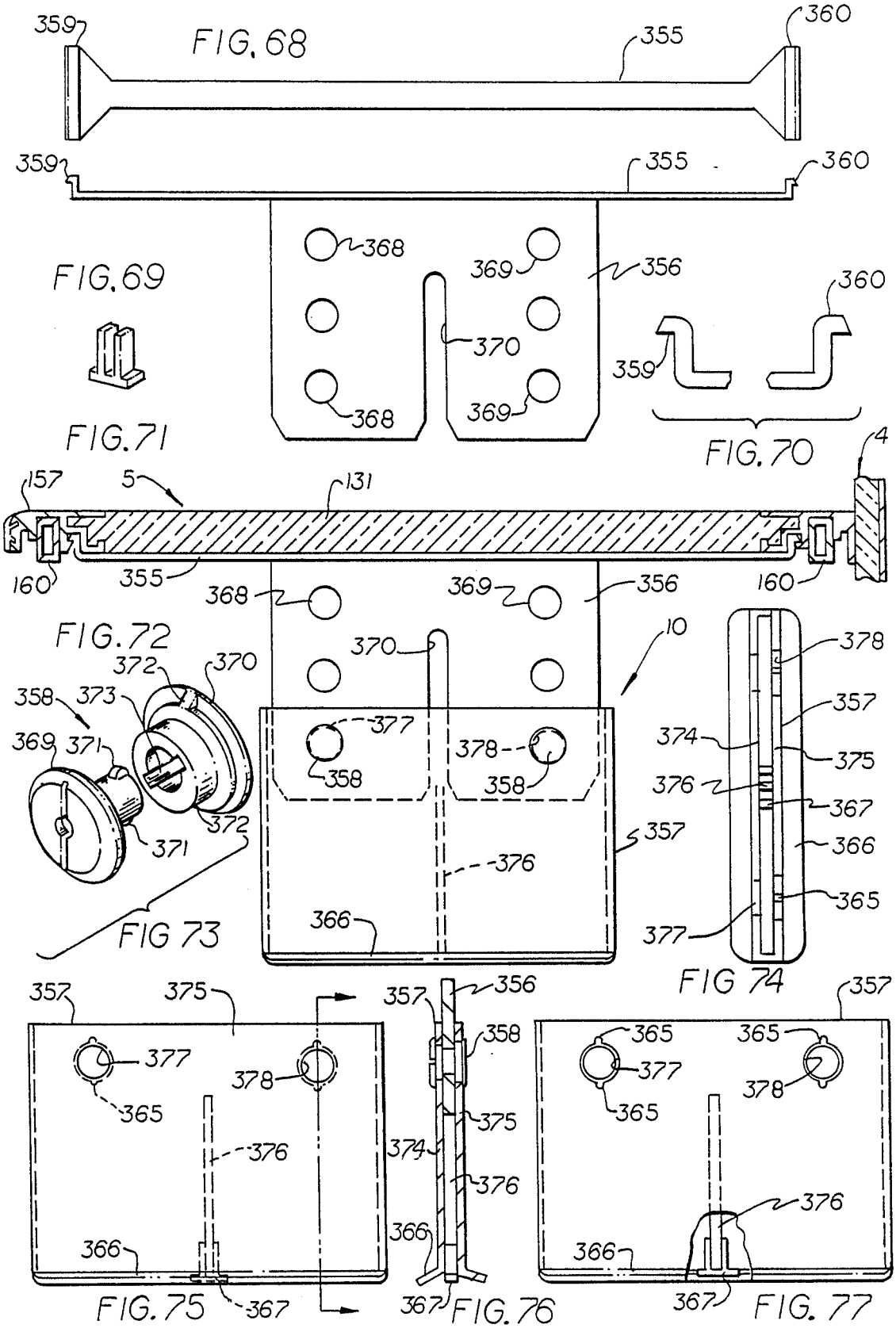
FIG. 68 is a top plan view of a jack plate member of a shelf jack portion of the dispensing rack.
FIG. 69 is a front elevational view of the jack plate.
FIG. 70 is an enlarged, fragmentary view of the jack plate, showing opposing ends thereof.
FIG. 71 is a perspective view of a foot portion of the shelf jack.
FIG. 72 is a vertical cross-sectional view of the dispensing rack, wherein the shelf jack is shown attached to one of the shelves.
FIG. 73 is an exploded, perspective view of a jack pin portion of the shelf jack.
FIG. 74 is a top plan view of a housing member portion of the shelf jack.
FIG. 75 is a side elevational view of the jack housing, taken from the right-hand side thereof.
FIG. 76 is a fragmentary, vertical cross-sectional view of the shelf jack, showing the jack pin installed therein.
FIG. 77 is a side elevational view of the jack housing, taken from the left-hand side thereof, and with a portion thereof broken away to reveal internal construction.

Jack housing 357 (FIGS. 72–77) also includes a flange 366, which extends along the lower edge thereof to facilitate supporting shelf jack 10 on the upper surface of one of the shelves 131. As best illustrated in FIG. 76, housing flange 366 has an upwardly bowed or convex side elevational shape, which serves to securely grip the abutting surface of shelf 131. A non-skid foot 367 is located along the lower edge of jack housing 357, between sidewalls 374 and 375, and is mounted on the lower end of rib 376. Foot 367 is constructed from a relatively soft friction material, such as rubber, or the like, and has its lowermost surface disposed generally planar with the outer edges of jack housing flange 366. When weight is transmitted between adjacent shelves 131 through shelf jack 10, foot 367 is compressed against the shelf and flange 366 elastically deforms, or flattens out in a manner which grips the abutting surface of shelf 131, thereby preventing shelf jack 10 from moving in a lateral or side-to-side direction.

Jack pins 358 each have a two-piece construction, comprising a male half 369 and a female half 370, which mate and lock to retain shelf jack 10 at a selected height. The male half 369 of jack pin 358 includes a slotted head in which a coin, screwdriver, or other similar tool may be received to rotate the same. The opposite end of pin half 369 includes a cylindrical post with a pair of radially protruding ears 371. The female half 370 of jack pin 358 includes an enlarged cylindrical head with opposite tabs 372 shaped and oriented to be received within the notches 365 of the housing apertures 377 and 378 in housing sidewall 375. Female pin half 370 includes a control slot 373 through which the ears 371 on male pin half 369 extend when jack pin 358 is assembled. When pin halves 369 and 370 are assembled, male pin half 369 is rotated 90 degrees to positively lock pin halves 369 and 370 together, and thereby prevent the sidewalls 374 and 375 of jack housing 357 from separating when shelf jack 10 is loaded.

In use, jack plate 356 is inserted telescopingly into jack housing 357, and the same are converged and diverged to vary the effective height of shelf jack 10 to correspond to the vertical distance between adjacent shelves 131. Jack pins 358 are then installed in shelf jack 10 in the manner described above to lock shelf jack 10 in the selected position. The barb-shaped ends of hanger bracket 355 are then inserted into the grooves 181 of shelf channels 157 and 158 at a laterally medial portion of shelf 131.

With reference to FIGS. 78–79, anchor caster 11 is attached to the center portion of the lowermost shelf 131, and engages the floor to provide extra vertical support to the shelves 131 through shelf jacks 10. In the illustrated example, anchor caster 11 (FIGS. 80–82) includes upper and lower housings 387 and 388, which are threadedly interconnected to provide vertical adjustment. A semispherically-shaped ball race 389 is mounted in lower caster housing 388. A spherically-shaped caster ball 390 is positioned within race 389, and is surrounded on its upper half by a plurality of ball bearings 391, which are held in place by a retainer plate 392. A threaded spindle 393 is mounted in and extends upwardly from lower caster housing 388, and is received in a threaded boss or eyelet 394 mounted in the upper caster housing 387. Rotation of lower caster housing 388 rotates threaded spindle 393 with respect to boss 394, thereby raising and lowering the height of caster ball 390 with respect to the adjacent floor surface 95. A slotted screwdriver head 396 is provided at the upper end of threaded spindle 393 to facilitate adjusting anchor caster 11 from the upper side of shelf 131. The upper end of upper caster housing 387 includes a circular plate 397 with an annular sleeve 398 protruding upwardly from the center thereof.

In operation, in the event that center support is desired for shelves 131, anchor caster 11 is installed in a centrally located through hole 399 (FIG. 79) in the lowermost shelf 131. The sleeve portion 398 of upper caster housing 387 is inserted into shelf hole 399, until caster plate 397 is flush with and abuts the lower surface of shelf 131. A fastener (not shown) may be inserted through a mating aperture in caster plate 397 and anchored in shelf 131 to positively mount anchor caster 11 on shelf 131, and prevent rotation between shelf 131 and upper caster housing 387. Lower caster housing 388 is then rotated to force caster ball 390 into contact with floor 395, thereby providing vertical support to shelves 131, and facilitating movement of rack 1 across the floor surface 395.

Figure 83:
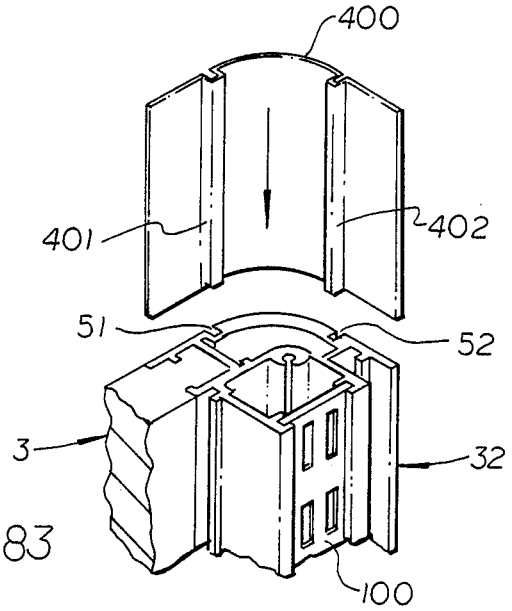
FIG. 83 is a perspective view of a corner protector portion of the dispensing rack, shown exploded away from a mating corner bracket.

With reference to FIG. 83, a guard strip 400 is provided to cover portions of the exterior surface of corner brackets 32 and 33, in order to protect the same. The illustrated guard strip 400 has a generally L-shaped top plan configuration, and is constructed from as relatively thin sheet of transparent synthetic resin material. Guard strip 400 has a smooth, durable exterior surface which resists denting and the like when hit or engaged by objects such as grocery carts, and other similar transport vehicles, as well as floor scrubbers, and other maintenance equipment. A pair of dovetail-shaped ribs 401 and 402 extend longitudinally along the interior surface of guard strip 400, and are shaped for close reception in the mating grooves 50 and 51 of corner brackets 32 and 33.

Figure 84:
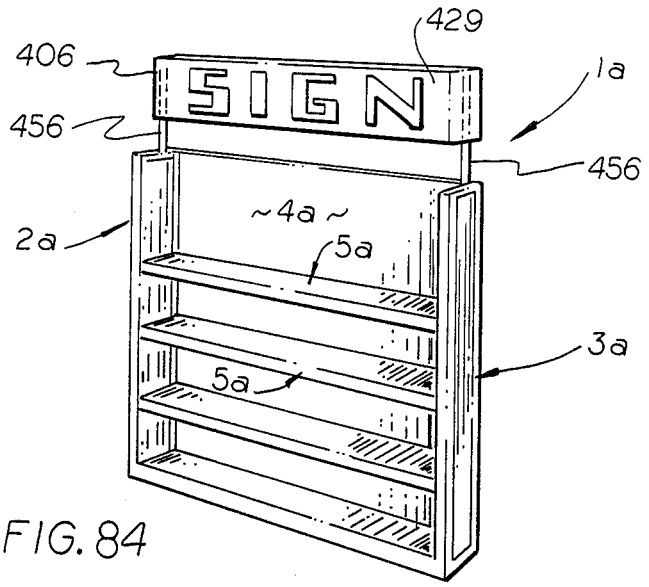
FIG. 84 is a perspective view of a low profile embodiment of the dispensing rack.

The reference numeral la (FIG. 84) generally designates a low profile embodiment of the present invention, having somewhat shorter end panels, and a unique header assembly 406. Since low profile rack la is similar to the previously described rack 1, similar parts appearing in FIGS. 1–83, and 84–95 are represented by the same, corresponding reference numeral, except for the suffix "a" in the numerals of the latter.

Figures 91, 92, 93, 94, 95:
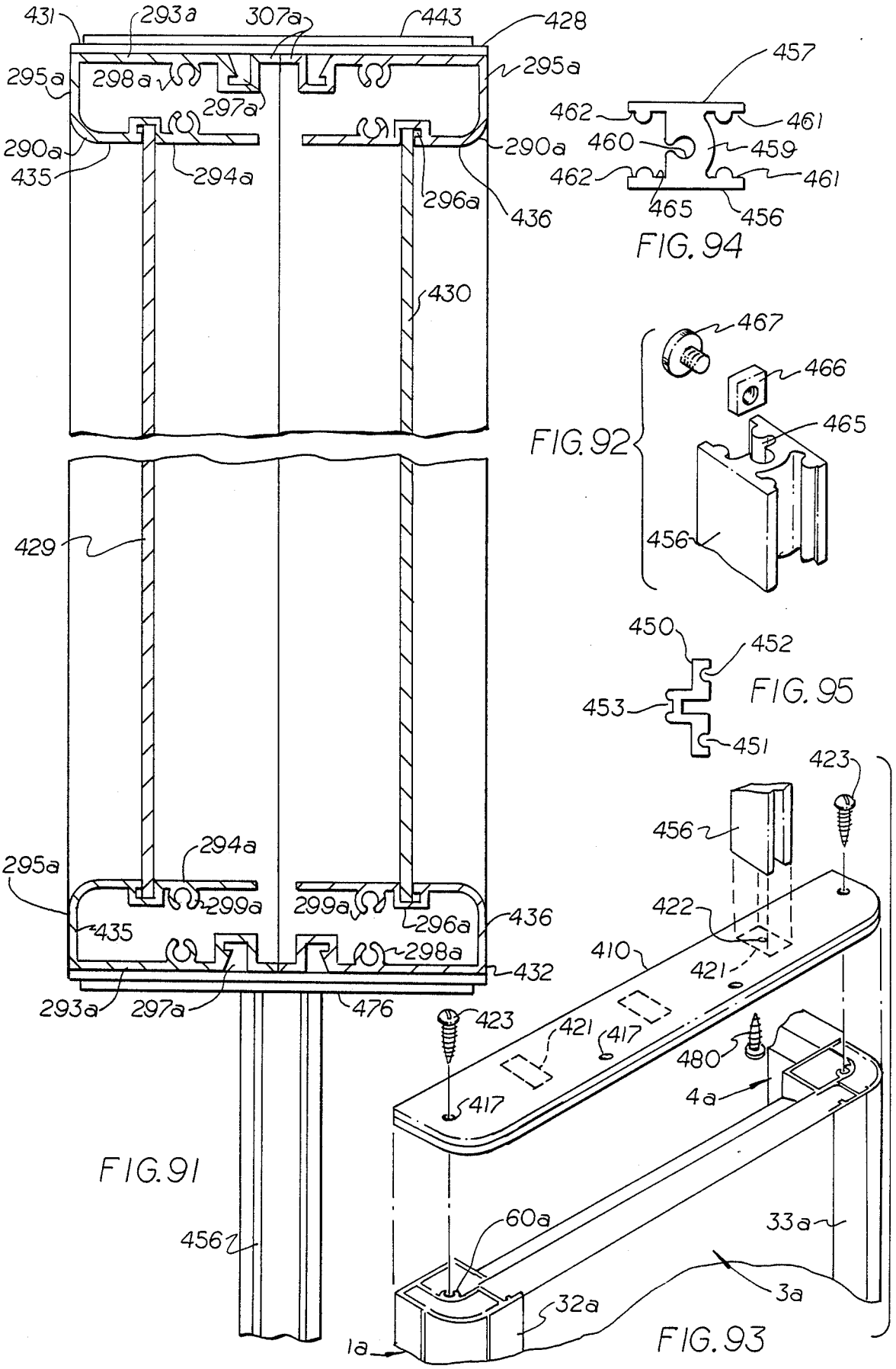
FIG. 91 is a fragmentary, vertical cross-sectional view of the low profile header.
FIG. 92 is a fragmentary perspective view of a stop portion of the low profile header.
FIG. 93 is a fragmentary, exploded perspective view of the low profile header.
FIG. 94 is a top plan view of a support post portion of the low profile header.
FIG. 95 is a top plan view of a connector strip portion of the low profile header.

Low profile rack 1*a* (FIGS. 84–85) includes a pair of top caps 410 and 411, which cover the upper ends of end panels 2*a* and 3*a*. Top caps 410 and 411 have a substantially identical construction, comprising a substantially rectangular plan configuration (FIGS. 87–89), with an inner edge 412, an outer edge 413, and curved end edges 414 and 415. A bevel 416 extends along the marginal edges 412–415 of top caps 410 and 411. Four countersunk fastener apertures 417 extends through top cap 410, adjacent the opposite ends thereof. Top cap 410 includes an integrally molded collar section 420, which extends downwardly from the lower surface thereof. Collar section 42 includes three reinforced areas 421, with associated fastener aperture bosses 422. The top plate portion of top caps 410 and 411 disposed directly above apertures 422 is weakened, such that they can be punched through or knocked out in a conventional fashion to extend a selected aperture 422 completely through the associated top cap. Reinforced cap areas 421 define three different locations at which header 406 may be mounted on end panels 2*a* and 3*a*, in the manner to be described below. As best illustrated in FIG. 93, a pair of threaded fasteners 423 extend through the outermost cap apertures 417, and into the mating bosses 60*a* on corner brackets 32*a* and 33*a*. Two more threaded fasteners 423 are inserted through the remaining innermost cap apertures 417, and are anchored in panel 20 to securely attach top caps 410 and 411 to the upper ends of end panels 2*a* and 3*a*.

Figure 85:
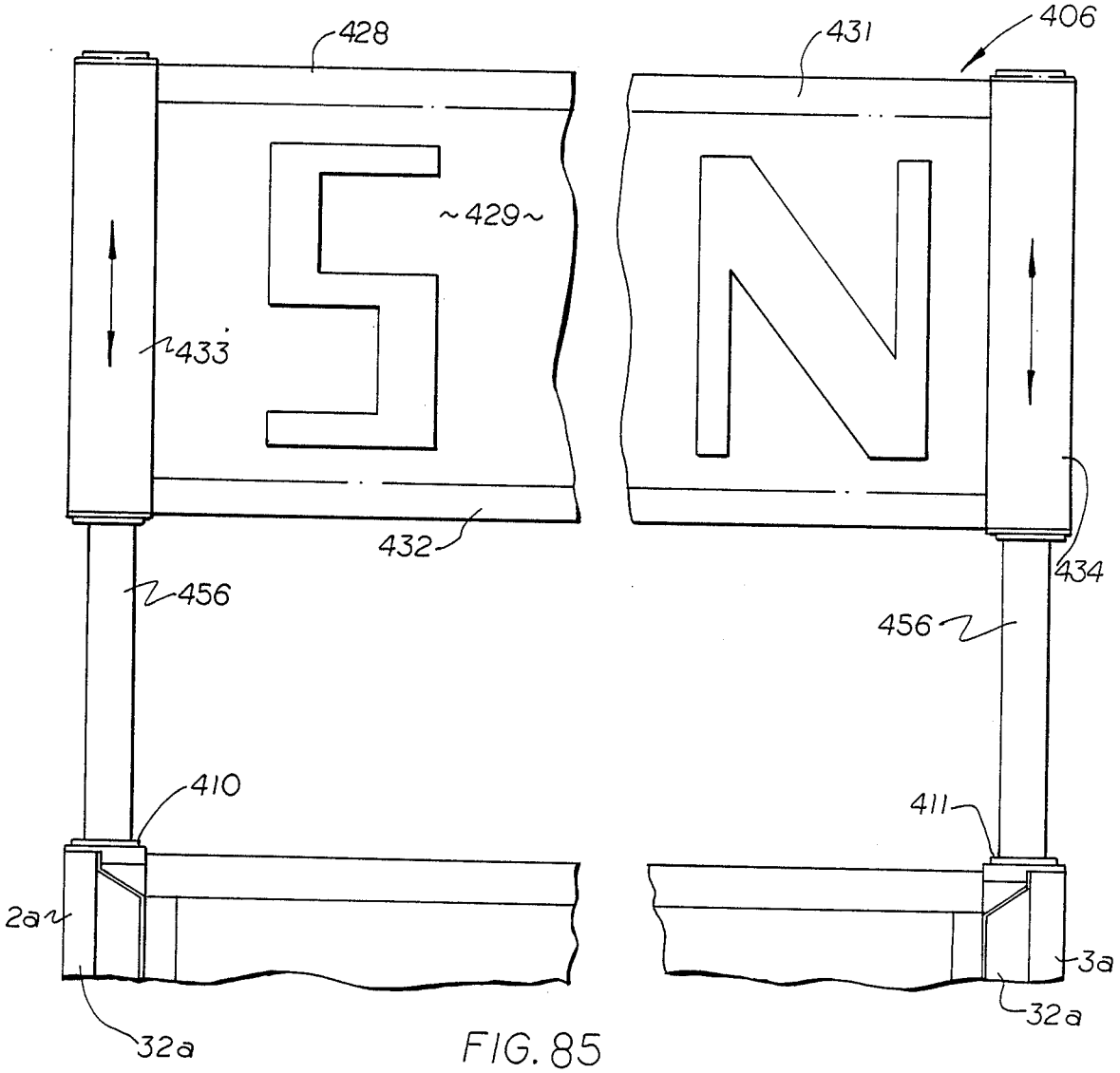
FIG. 85 is a fragmentary, front elevational view of a header portion of the low profile dispensing rack.

With reference to FIG. 85, low profile header 406 is supported on end panels 2*a* and 3*a*, and extends above the upper ends thereof. The illustrated low profile header 406 has a substantially rectangular front elevational configuration, and comprises a marginal frame 428, in which a pair of display panels 429 and 430 (FIG. 91) are supported. Frame 428 has a unique construction, comprising upper and lower segments 431 and 432, and opposite end segments 433 and 434. As best illustrated in FIG. 91, the upper and lower segments 431 and 432 of low profile header frame 428 are substantially identical, and comprise two segments of channel 435 and 436 which ar identical in shape with previously described header channel 290 and 291. For ease of description, similar parts appearing in header channels 290 & 291 and 431 & 432 are represented by the same, corresponding reference numeral, except for the suffix "a" in the numerals of the latter. Channels 435 and 436 are arranged back-to-back, with rounded ends 290*a* facing outwardly. A top strip 443 covers flanges 293*a* of channels 435 and 436 to hide the joint formed therebetween. Grooves 296*a* in channels 435 and 436 capture and retain the upper and lower edges of display panels 429 and 430 therein.

The side segments 433 and 434 (FIG. 86) of low profile header frame 428 also have a unique construction, comprising a pair of channels 448 and 449 constructed from segments of the same stock material from which corner brackets 32 and 33 are constructed. For ease of description, similar parts appearing in corner brackets 32–33 and channels 448–449 are represented by the same reference numerals, except for the suffix "a" in the numerals of the latter. Channels 448 and 449 are arranged with their first faces 38*a* aligned and abutting one another. A T-shaped connector strip 450 extends between the walls 40*a* and 41*a* of channels 448 and 449, and includes two outer grooves 451 and 452 (FIG. 95) in which ribs 52*a* on outer walls 40*a* are received, and a center groove 453 in which both ribs 53*a* on inner walls 41*a* are received. Connector strip 450 is slid longitudinally in place between bracket walls 40*a* and 41*a* of header channels 448 and 449, and positively interconnects the same in the abutting, end-to-end relationship illustrated in FIG. 86.

Low profile header 406 also includes a pair of support posts 456 (FIG. 86), which have a generally H-shaped transverse cross-sectional configuration, with opposite flanges 457 and 458 (FIG. 94) and interconnecting web 459. Web 459 includes a screw boss 460 to facilitate attaching the lower ends of support post 456 to end panels 2*a* and 3*a*, as described below. The outward ends of support post flanges 457 and 458 include L-shaped ledges 461 between which the outermost ribs defining grooves 57*a* are captured. The inner ends of support post flanges 457 and 458 also include ledges 462, between which the inward ribs forming grooves 56*a* are captured, such that support posts 456 also serve to positively interconnect channels 448 and 449. As best illustrated in FIG. 92, support posts 456 also include generally rectangular slot or keyway 465 in which a nut 466 is slidingly received. A mating screw 467 threadedly engages nut 466, and when tightened, positions header frame 428 on support post 456.

The side edges of display panels 429 and 430 (FIG. 86) are retained in header frame 428 by a pair of C-shaped brackets 470 and 471. Brackets 470 and 471 are substantially identical in shape, and each includes a center web 472 attached to the associated display panel 429 and 430, and opposite end flanges 473 and 474. Outer bracket flange 473 engages outer bracket wall 40*a*, and abuts against rib 52*a*. The web portions 472 of brackets 470 and 471 include lanced tabs 478 which protrude laterally outwardly, and engage channel rib 53*a* to retain display panels 429 and 430 in frame 428. A pair of top and bottom caps 475 and 476 respectively are attached to the upper ends of channels 433 and 434 by fasteners 477, which are engaged in channel bosses 60*a*.

Low profile header 406 is mounted on end panels 2*a* and 3*a* in the following manner. Support posts 456 are located over a laterally aligned pair of the reinforced areas 421 on top caps 410 and 411. The position of low profile header 406 may be adjusted in a fore-to-aft direction by selecting appropriate reinforced areas 421. The two fastener apertures 422 associated with the two selected reinforced top cap areas 421 are then punched through the upper skins or surfaces of top caps 410 and 411. The lower ends of support posts 456 are positioned over the selected reinforced areas 421 of top caps 410 and 411, in the manner best shown in FIG. 93, and fasteners 480 are inserted through the selected punched through apertures 422 from the bottom sides of top caps 410 and 411, and threaded into the screw bosses 460 of support posts 456. Top caps 410 and 411, with support posts 456 mounted thereon, are then attached to the upper ends of end panels 2*a* and 3*a*, and fasteners 423 are installed to securely retain the same in place. Screw stops 467 are adjusted vertically along support posts 456, and tightened in place. Header frame 428 is then lowered onto support posts 456, with the upper ends of support posts 456 being closely and slidingly received within frame side channels 433 and 434, in the relationship previously described and illustrated in FIG. 86. Header frame 428 is lowered downwardly on support posts 456 until it abuts screw stops 467, which support and position header frame 428 vertically above end panels 2*a* and 3*a*.

Both dispensing racks 1 and 1*a* have a unique knockdown construction that permits quick and easy assembly and disassembly, without requiring any tools whatsoever. The construction of racks 1 and 1*a* is also modular, with interchangeable end panels 2 and 3, back panels 4, shelf assembly 5 to facilitate varying the size and shape of the dispensing rack to increase versatility and greatly reduce manufacturing costs. Hanging row dividers 8 stabilize and separate adjacent stacks of articles. Adjustable shelf jack 10 and anchor casters 11 provide extra rigidity for the shelf assemblies 5, and facilitate moving the rack from one location to another. Header assembly 406 uses common parts to construct the low profile rack 1*a*.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows.

1. A knockdown dispensing rack for stacked articles and the like, comprising:

first and second end panels shaped to be supported on a surface in a laterally spaced apart, generally upright, and freestanding condition; said first and second end panels including generally closed corner brackets with at least first and second slotted portions respectively, which extend generally longitudinally therealong in a mutually parallel relationship, and define spaces with a transversely measured width within the interior of said corner brackets; said first and second slotted portions including at least first and second slots extending respectively therethrough, which are normally, generally laterally aligned;

at least one shelf adapted to support articles thereon, and including a laterally extending, downwardly opening groove which extends along a substantial portion thereof;

at least one support bar shaped to extend between said end panels, and being sufficiently rigid to laterally interconnect said first and second end panels, and support at least a portion of said shelf thereon, with said support bar being closely received in said shelf groove to rigidify said dispenser rack; said support bar including first and second ends shaped for close reception in said first and second slots respectively, with the width of said corner bracket spaces being substantially greater than the length of said bar ends to permit said support bar to shift laterally therein; said first bar end including a first, downwardly opening notch shaped to closely receive therein a lower edge of said first slot; said second bar end including a second, downwardly opening notch shaped to closely receive therein a lower edge of said second slot; said first and second notches being spaced apart a preselected distance substantially equal to the lateral distance between said first and second slots, such that said end panels are set spaced apart in the upright, freestanding condition for detachable assembly and interconnection in a knockdown fashion by said support bar, with the first end of said support bar being inserted into said first slot past said first notch, and said support bar is being then bodily translated longitudinally in the opposite direction to insert the second end of said support bar into said second slot until said first and second notches contemporaneously engage the lower edges of said first and second slots respectively, thereby facilitating quick and easy assembly of said end panels without either moving the same from their set position, or requiring any tools.

2. A dispensing rack as set forth in claim 1, wherein:

said shelf includes opposite end edges spaced apart a distance substantially equal to the lateral distance between said first and second slots, such that said shelf laterally rigidifies said dispensing rack.

3. A dispensing rack as set forth in claim 2, wherein:

said first and second end panel slotted portions include third and fourth slots extending respectively therethrough, which are normally generally laterally aligned, and are spaced vertically apart from said first and second slots; and including a second support bar substantially similar to said first-named support bar, and mounted in said third and fourth slots.

4. A dispensing rack as set forth in claim 3, including:

a second shelf, substantially similar to said first-named shelf, and having at least a portion thereof supported on said second support bar.

5. A dispensing rack as set forth in claim 4, wherein said first and second end panels each have a modular construction comprising:

a rigid, flat panel having an upper edge, a lower edge, and opposite side edges;

a pair of said corner brackets rigidly attached to said panel, and extending continuously along the opposite side edges of said panel between the upper and lower edges thereof.

6. A dispensing rack as set forth in claim 5, said first and second end panel slotted portions comprise first and second, slotted, bar-shaped uprights connected with said first and second end panels respectively.

7. A dispensing rack as set forth in claim 6, each of said corner brackets includes first and second, oppositely facing grooves extending longitudinally along the length thereof in which an associated one of said slotted uprights is received and retained.

8. A dispensing rack as set forth in claim 7, wherein:

each of said support bars includes a shoulder on at least one end thereof, which projects laterally outwardly thereof to selectively abut an associated one of said first and second slotted uprights for longitudinally positioning the-other end of said support bar adjacent to an associated one of said slots.

9. A dispensing rack as set forth in claim 8, wherein:

said first slot comprises a first pair of slots positioned in a side-by-side fashion;

said second slot comprises a second pair of slots positioned in a side-by-side fashion; and said first and second ends of said first-named support bar each include a pair of longitudinally extending prongs shaped for close reception in said first and second pairs of slots.

10. A dispensing rack as set forth in claim 9, wherein:

each of said corner brackets has a generally L-shaped lateral cross-sectional shape, with first and second faces;

said first corner bracket faces include said first and second grooves in which said uprights are received and retained; and said second corner bracket faces are connected with said panel.

11. A dispensing rack as set forth in claim 10, wherein:

said corner brackets are each constructed from a length of elongated stock having a lateral cross-sectional shape that is substantially uniform along its length.

12. A dispensing rack as set forth in claim 11, including:

a header assembly having slides at opposite ends thereof shaped for close reception in said first and second grooves of a forwardly oriented pair of said corner brackets.

13. A dispensing rack as set forth in claim 12, wherein:

said corner brackets each include a third groove extending along the first face thereof, positioned exterior to said first and second facing grooves.

14. A dispensing rack as set forth in claim 13, including:

at least one back panel, having opposite side edges shaped for reception in said third grooves of a rearwardly oriented pair of said corner brackets.

15. A dispensing rack as set forth in claim 14, including:

at least two of said back panels, each having an upper edge, a lower edge, with the opposite side edges thereof received in the third grooves of the rearwardly oriented pair of said corner brackets; said upper and lower edges of said back panels having wedgingly mating shapes which mate when assembled in a vertically stacked relationship to structurally interconnect said back panels, and form a seal therebetween.

16. A dispensing rack as set forth in claim 15, wherein:

said corner brackets each include a fourth groove extending along the second face thereof.

17. A dispensing rack as set forth in claim 16, including:

at least one inner panel, having opposite side edges shaped for reception in said fourth grooves of opposite corner brackets on one of said end panels.

18. A dispensing rack as set forth in claim 17, wherein:

said inner panel is shaped to form a substantially planar surface between the corner brackets of said one end panel to facilitate insertion and removal of articles from said dispensing rack.

19. A dispensing rack as set forth in claim 18, wherein:

said inner panel includes at least one laterally extending, interior facing indentation to facilitate visually locating said shelves at a predetermined height.

20. A dispensing rack as set forth in claim 19, including:

at least one cover strip shaped for reception in said third groove of a forwardly oriented one of said corner brackets, and closing the same.

21. A dispensing rack as set forth in claim 20, including:

a row stabilizer extending vertically between said first and second shelves, and adapted to separate and stabilize adjacent vertical rows of stacked articles.

22. A dispensing rack as set forth in claim 21, including:

a shelf jack extending vertically between said first and second shelves, and providing vertical rigidity therebetween.

23. A dispensing rack as set forth in claim 22, wherein:

each of said shelves comprises a rigid panel having a forward edge, a rearward edge, and opposite end edges, and a pair of channel members connected with the forward and rearward edges of said shelf panel and extending therealong; said channel members each including said shelf groove therein, extending along a lower face thereof.

24. A dispensing rack as set forth in claim 23, wherein:

each of said shelves is supported on a pair of said support bars having the opposite ends thereof mounted in said slotted uprights; and said support bars are closely received in the channel member grooves of said shelves.

25. A dispensing rack as set forth in claim 1, wherein:

said shelf includes opposite end edges spaced apart a distance substantially equal to the lateral distance between said first and second slots, such that said shelf laterally rigidifies said dispensing rack.

26. A dispensing rack as set forth in claim 1, wherein:

said first and second end panel slotted portions include third and fourth slots extending respectively therethrough, which are normally generally laterally aligned, and are spaced vertically apart from s id first and second slots; and including a second support bar substantially similar to said first-named support bar, and mounted in said third and fourth notches.

27. A dispensing rack as set forth in claim 1, wherein:

said first and second end panel slotted portions comprise first and second, slotted, bar-shaped uprights connected with said first and second end panels respectively.

28. A dispensing rack as set forth in claim 1, wherein:

said support bar includes a shoulder on at least one end thereof, which projects laterally outwardly thereof to selectively abut an associated one of said first and second slotted uprights for longitudinally positioning the other end of said support bar adjacent to an associated one of said slots.

29. A dispensing rack as set forth in claim 1, wherein said first and second end panels each have a modular construction comprising:

a rigid, flat panel having an upper edge, a lower edge, and opposite side edges;

a pair of elongated corner brackets rigidly attached to said panel, and extending continuously along the opposite side edges of said panel between the upper and lower edges thereof.

30. A dispensing rack as set forth in claim 29, including:

a header assembly having slides at opposite ends thereof shaped for close reception in first and second grooves in a forwardly oriented pair of said corner brackets.

31. A dispensing rack as set forth in claim 29, including:

at least two back panels, each having an upper edge, a lower edge, and the opposite side edges thereof received in third grooves of a rearwardly oriented pair of said corner brackets; said upper and lower edges of said back panels having wedgingly mating shapes which abuttingly interconnect said back panels, and form a seal therebetween.

32. A dispensing rack as set forth in claim 29, including:

at least one inner panel, having opposite side edges shaped for reception in a pair of grooves in opposite corner brackets on one of said end panels.

33. A dispensing rack as set forth in claim 29, including:

at least one cover strip shaped for reception in a groove of a forwardly oriented one of said corner brackets.

34. A dispensing rack as set forth in claim 1, including:

a second shelf extending between said end panels;

a row stabilizer extending vertically between said first and second-named shelves, and adapted to separate and stabilize adjacent vertical rows of stacked articles.

35. A dispensing rack as set forth in claim 1, including:

a second shelf extending between said end panels;

a laterally flat, narrow shelf jack extending vertically between said first and second shelves, and providing vertical rigidity therebetween.

36. A dispensing rack as set forth in claim 1, wherein:

said slots each comprise a pair of slots positioned in a side-by-side fashion;

said first and second ends of said support bar each include a pair of longitudinally extending prongs shaped for close reception in said pairs of slots.

37. A dispensing rack as set forth in claim 1, wherein:

said first and second slotted portions are disposed adjacent to a forward edge of said shelf;

said first and second end panels include third and fourth slotted portions respectively, which extend generally longitudinally therealong in a mutually parallel relationship adjacent to a rearward edge of said shelf;

said shelf includes a pair of laterally extending, downwardly opening grooves disposed adjacent to the forward and rearward edges thereof;

said is supported on a pair of said shelf support bars, which have the ends thereof detachably mounted in the slotted portions of said end panels; said support bars being closely received in the grooves of said shelves to provide fore-to-aft rigidity.

38. A dispensing rack as set forth in claim 1, wherein:

said first and second end panel slotted portions include third and fourth slots extending respectively therethrough, which are normally generally laterally aligned, and are spaced horizontally apart form said first and second slots; and including a second support bar substantially similar to said first-named support bar, and mounted in said third and fourth slots in a bore-to-aft relationship with said first-named support bar.

39. A dispensing rack as set forth in claim 38, wherein:

said shelf includes first and second downwardly opening grooves positioned adjacent opposite side edges of said shelf, extending along substantial portions thereof, and closely receiving said support bars therein to rigidify said dispenser rack.

40. A modular rack construction, comprising:

a pair of end panels, each having:

a rigid, flat panel with an upper edge, a lower edge, and opposite side edges;

a pair of elongated corner brackets rigidly attached to said panel and extending continuously along the opposite side edges of said panel between the upper and lower edges thereof; said corner brackets having a generally L-shaped lateral cross-sectional configuration, with first and second faces;

at least one pair of slotted uprights operably connected with the first faces of an associated pair of said corner brackets on said end panels, and having a plurality of slots extending therethrough;

at least one shelf adapted to support articles thereon;

at least one shelf support bar shaped to extend between said end panels and abuttingly support at least a portion of said shelf thereon; said shelf bar having opposite ends shaped for insertion into selected slots in said uprights, and including means for releasably engaging the same, and wherein said corner brackets are each constructed from a length of elongated stock having a lateral cross-sectional shape that is substantially uniform along its length;

said corner brackets each include first and second oppositely facing grooves in the first face thereof in which said slotted uprights are selectively received and retained;

said corner brackets each include a third groove extending along the first face thereof, positioned exterior to said first and second grooves; and at least one back panel, having opposite side edges shaped for reception in said third grooves of a rearwardly oriented pair of said corner brackets.

41. In a rack for the type having end panels with at least two shelves extending therebetween, the improvement of an adjustable shelf jack, comprising:

a sleeve-shaped jack housing, having a first end thereof, and a second end thereof adapted for abutting support on one of said shelves; said jack housing including at least one pair of laterally aligned apertures therethrough;

a jack plate having a first end thereof telescopingly received in said jack housing, and a second end thereof adapted for abutting support on the other one of said shelves; said jack plate including a plurality of laterally extending, vertically spaced apart apertures therethrough positioned to selectively align with said pair of jack housing apertures;

a jack pin shaped for lateral insertion through a selected one of said jack plate apertures and said jack housing apertures, and being operably retained therein to set said jack at a selected height for close reception between said shelves, whereby said jack can be easily adjusted to fit snugly between said shelves to provide secure vertical rigidity therebetween, and wherein said jack pin has a two-piece construction with interlocking male and female portions to prevent inadvertent removal from said jack housing;

said jack plate includes a hanger bracket disposed along the second end of said jack plate, and includes opposite ends with means for releasably connecting the same with a lower portion of said other shelf, whereby at least a portion of said shelf jack is at least temporarily suspended from said other shelf to facilitate positioning said shelf jack; and said other shelf includes a lower portion, with a pair of barb-shaped grooves extending laterally therealong adjacent and rearward of said other shelf; said grooves being shaped to closely receive the opposite ends of said hanger bracket therein, and permit lateral translation of said hanger bracket therein, and permit lateral translation of said hanger bracket along said grooves to facilitate lateral positioning of said shelf jack.

* * * * *